US011919831B2

(12) United States Patent
Graham et al.

(10) Patent No.: US 11,919,831 B2
(45) Date of Patent: Mar. 5, 2024

(54) PHASE-STABILIZED AMMONIUM NITRATE PRILLS AND RELATED PRODUCTS AND METHODS

(71) Applicant: Dyno Nobel Asia Pacific Pty Limited, Southbank (AU)

(72) Inventors: Brian Graham, Singleton (AU); Jeff Gore, Singleton (AU)

(73) Assignee: Dyno Nobel Asia Pacific Pty Limited (AU)

( * ) Notice: Subject to any disclaimer, the term of this patent is extended or adjusted under 35 U.S.C. 154(b) by 656 days.

(21) Appl. No.: 16/782,792

(22) Filed: Feb. 5, 2020

(65) Prior Publication Data

US 2020/0247728 A1 Aug. 6, 2020

Related U.S. Application Data

(63) Continuation of application No. PCT/AU2020/050069, filed on Feb. 3, 2020.

(30) Foreign Application Priority Data

Feb. 5, 2019 (AU) ..... 2019900348
Nov. 25, 2019 (AU) ..... 2019904447

(51) Int. Cl.
*C06B 31/28* (2006.01)
*C06B 31/00* (2006.01)
*C06B 33/06* (2006.01)

(52) U.S. Cl.
CPC ..... *C06B 31/28* (2013.01)

(58) Field of Classification Search
CPC ..... C06B 31/28; C06B 33/06; C06B 31/00
USPC ..... 149/43, 45, 46
See application file for complete search history.

(56) References Cited

U.S. PATENT DOCUMENTS 2,602,026 A 7/1952 Farr et al.
2,794,701 A 6/1957 Ames
3,199,950 A 8/1965 Austin
3,301,722 A 1/1967 Mohaupt
3,317,276 A 5/1967 Brown et al.
3,418,255 A 12/1968 Brown et al.
3,630,712 A 12/1971 Brown et al.
4,552,736 A * 11/1985 Mishra ..... C01C 1/18 423/396

(Continued)

FOREIGN PATENT DOCUMENTS

EP 0648528 A1 4/1995
GB 800794 A 9/1958

(Continued)

OTHER PUBLICATIONS

International Search Report and Written Opinion dated Apr. 20, 2020 for PCT/AU2020/050069.

(Continued)

*Primary Examiner* — James E McDonough
(74) *Attorney, Agent, or Firm* — Dorsey & Whitney LLP

(57) ABSTRACT

Phase-stabilized ammonium nitrate (PSAN) prill including ammonium nitrate and a potassium salt are provided. The PSAN prill can be explosive grade and low density. The PSAN prill may include a porosity enhancing agent such as an interfacial surface modifier or a pore former. Methods of preparing the PSAN prill and related emulsions are also provided.

13 Claims, 28 Drawing Sheets

(56) References Cited

U.S. PATENT DOCUMENTS

| | | | | |
|---|---|---|---|---|
| 4,736,683 | A | 4/1988 | Bachman et al. | |
| 5,034,071 | A | 6/1991 | Vanommeren | |
| 5,098,683 | A | 3/1992 | Mehrotra et al. | |
| 5,567,910 | A | 10/1996 | Chattopadhyay | |
| 5,596,168 | A * | 1/1997 | Menke | C06B 31/30 149/19.6 |
| 5,641,938 | A * | 6/1997 | Holland | C06B 31/32 149/78 |
| 5,723,812 | A | 3/1998 | Berteleau et al. | |
| 6,149,746 | A | 11/2000 | Blomquist et al. | |
| 6,365,120 | B1 | 4/2002 | Grandquist et al. | |
| 6,398,888 | B2 | 6/2002 | Chattopadhyay | |
| 6,872,265 | B2 | 3/2005 | Hamilton | |
| 6,951,589 | B2 | 10/2005 | Pollack et al. | |
| 8,157,935 | B2 | 4/2012 | Visagie | |

FOREIGN PATENT DOCUMENTS

| | | | | |
|---|---|---|---|---|
| GB | 1189448 | A | 4/1970 | |
| KR | 20000015463 | | 3/2000 | |
| WO | 200112557 | | 3/2001 | |
| WO | 2004069748 | | 8/2004 | |
| WO | WO-2013071363 | A1 * | 5/2013 | C06B 23/00 |
| WO | 2017186400 | | 11/2017 | |
| WO | 2020160596 | | 8/2020 | |

OTHER PUBLICATIONS

Engel, et al., Investigation of the Phase Stabilizing Effect of Potassium Fluoride on Ammonium Nitrate, Fraunhofer-Institut fur Chemische Technologie , Jul. 1989.

Oommen, et al., Ammonium Nirate: A Promising Rocket Propellant Oxidizer, Journal of Hazardous Materials, A67 , 1999 ,253-281.

Oommen, et al., Phose Modification of Ammonium Nitrate by Potassium Salts, Journal of Thermal Analysis and Calorimetry, vol. 55 , 1999 ,903-918.

Producing Phase Stapilized Ammonium Nitrate, Swiss Propulsion Laboratory ,Aug. 22, 2000.

Reusing Ammonium Nitrate for Wet Air Oxidation, Industrial Health & Hazards Update vol. 2000 Issue 7, Merton Allen Associates ,Jul. 2000.

Engel, et al., Investigation of the Phase Stabilizing Effect of Potassium Fluoride on Ammonium Nitrate, Fraunhofer-Instutut fur Chemische Technologie, D 7507 Pfinztal-Berghausen, W. Germany ,Jul. 1989.

Maloney, et al.,Reuse of Ammonium Nitrate: Wet Air Oxidation, US Army Corp of Engineers, Engineer Research and Development Center, CERL Technical Report 99/74 ,Sep. 1999.

Oxley, et al.,Thernal Stability and Compatibility of Ammonium Nitrate Explosives on a Small and Large Scale, Thermochimica Acta, 212, Elsivier Science Publishers B.V., Amsterdam , 1992 ,77-85.

Vyazenova, et al., Phase Stabilization of Ammonium Nitrate by Double Addition of Potassium Nitrate and Melamine, ISSN, Russian Journal of Applied Chemistry, vol. 90 No. 9 ,2017 ,1392-1396.

International Search Report and Written Opinion dated Oct. 21, 2021 for PCT/AU2021/050812.

Liu , "Pharmaceutics (2nd Edition)", People's Medical Publishing House, 2nd Edition, May 31, 1985, 155-156.

Zhang , "Fine Chemical Formulations", Chemical Industry Press, 1st Edition, May 31, 2001, 270.

European Search Report dated Sep. 26, 2022 for EP207526583.

Oommen , et al., "Ammonium Nitrate: A Promising Rocket Propellant Oxidizer", Journal of Hazardous Materials, A67, 1999, 253-281.

Mahadevan, "Ammonium Nitrate Explosives for Civil Applications", Wiley-VCH Verlag Gmbh & co. KGaA, 2013, 7 pgs.

* cited by examiner

| Sample | Average Crush Strength (kg) Initial (0 cycles) | Average Crush Strength (kg) 20 cycles | %Change from Initial Average Crush Strength (20 cycles) | Average Crush Strength (kg) 50 cycles | %Change from Initial Average Crush Strength (35 cycles) | Average Crush Strength (kg) 75 cycles | %Change from Initial Average Crush Strength (75 cycles) |
|---|---|---|---|---|---|---|---|
| AN Only | 2.480 | 1.066 | -57.0 | Unable to Crush – sample is dust | | Unable to Crush – sample is dust | |
| AN+GAL | 2.850 | 0.485 | -83.0 | Unable to Crush – sample is dust | | Unable to Crush – sample is dust | |
| AN+$KNO_3$ (3.5 mol%) | 0.453 | 0.334 | -26.3 | 0.234 | -48.3 | 0.070 | -84.5 |
| AN+GAL +3.5 mol% $KNO_5$ | 1.657 | 1.989 | 20.0 | 2.234 | 34.8 | 3.289 | 98.5 |
| Sample | Average Crush Strength (kg) Initial (0 cycles) | Average Crush Strength (kg) 100 cycles | %Change from Initial Average Crush Strength (100 cycles) | Average Crush Strength (kg) 150 cycles | %Change from Initial Average Crush Strength (150 cycles) | Average Crush Strength (kg) 200 cycles | %Change from Initial Average Crush Strength (200 cycles) |
| AN Only | 2.480 | Unable to Crush – sample is dust | | Unable to Crush – sample is dust | | Unable to Crush – sample is dust | |
| AN+GAL | 2.850 | Unable to Crush – sample is dust | | Unable to Crush – sample is dust | | Unable to Crush – sample is dust | |
| AN+$KNO_3$ (3.5 mol%) | 0.453 | 0.042 | -90.7 | Unable to Crush – sample is dust | | Unable to Crush – sample is dust | |
| AN+GAL +3.5 mol% $KNO_3$ | 1.657 | 3.085 | 86.2 | 2.522 | 52.2 | 2.766 | 66.9 |

*FIG. 12*

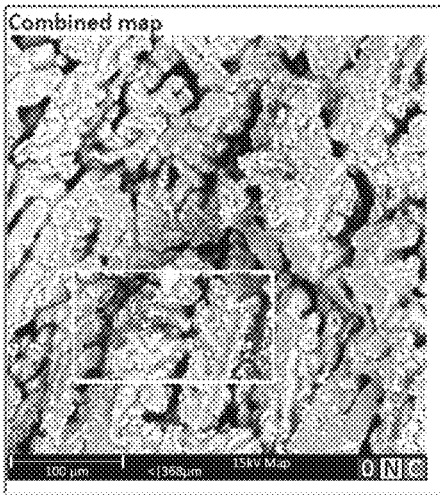
| Element Number | Element Symbol | Element Name | Atomic Conc. | Weight Conc. |
|---|---|---|---|---|
| 8 | O | Oxygen | 53.43 | 56.95 |
| 7 | N | Nitrogen | 43.53 | 40.62 |
| 6 | C | Carbon | 3.04 | 2.44 |
Cut out of map (resolution: 128x70 pixels)
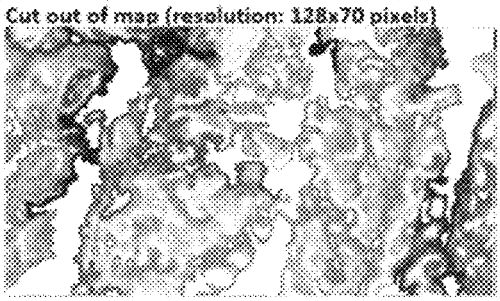
*FIG. 20A*
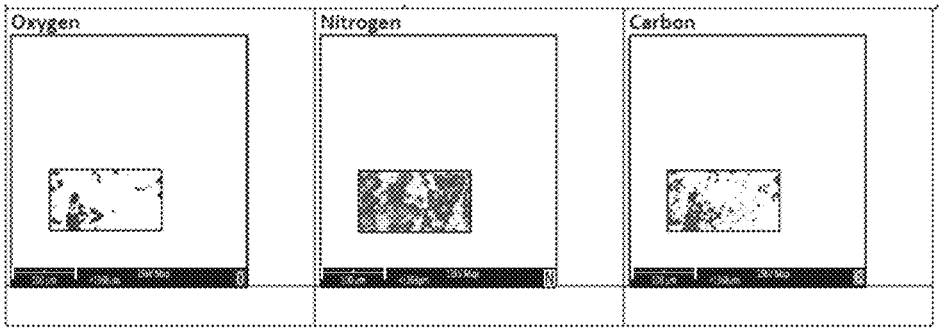
*FIG. 20B*

| Element Number | Element Symbol | Element Name | Atomic Conc. | Weight Conc. |
|---|---|---|---|---|
| 8 | O | Oxygen | 54.07 | 56.97 |
| 7 | N | Nitrogen | 42.87 | 39.54 |
| 6 | C | Carbon | 2.46 | 1.94 |
| 19 | K | Potassium | 0.60 | 1.55 |

Cut out of map (resolution: 128x85 pixels)

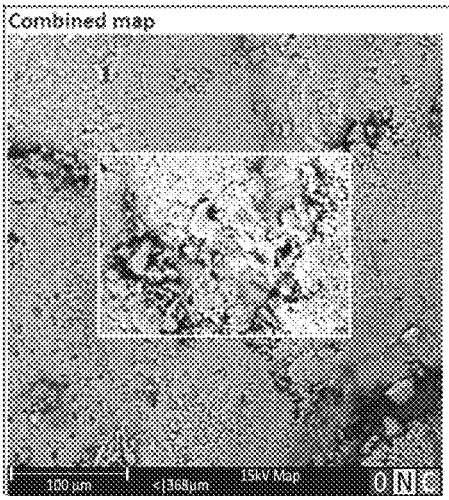
| Element Number | Element Symbol | Element Name | Atomic Conc. | Weight Conc. |
|---|---|---|---|---|
| 8 | O | Oxygen | 50.04 | 53.60 |
| 7 | N | Nitrogen | 43.89 | 41.31 |
| 6 | C | Carbon | 6.06 | 4.89 |
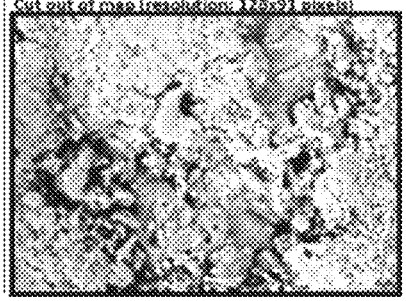
*FIG. 22A*
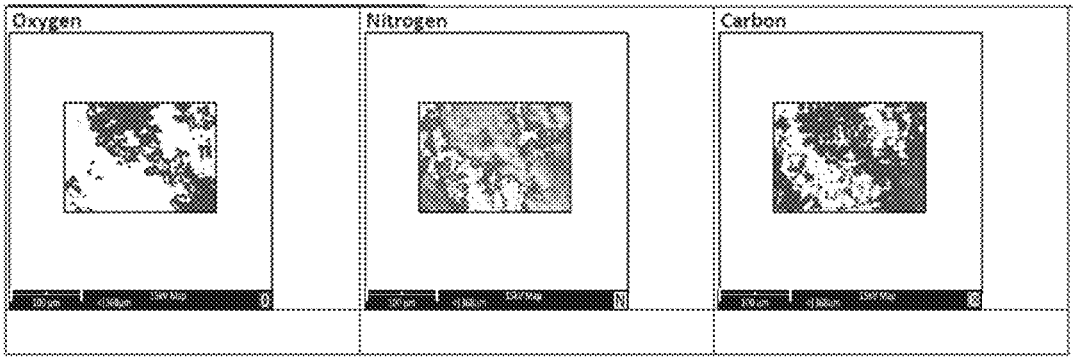
*FIG. 22B*

| Element Number | Element Symbol | Element Name | Atomic Conc. | Weight Conc. |
|---|---|---|---|---|
| 8 | O | Oxygen | 52.77 | 56.09 |
| 7 | N | Nitrogen | 41.69 | 38.79 |
| 6 | C | Carbon | 5.15 | 4.11 |
| 19 | K | Potassium | 0.39 | 1.01 |

PHASE-STABILIZED AMMONIUM NITRATE PRILLS AND RELATED PRODUCTS AND METHODS

CROSS-REFERENCE TO RELATED APPLICATIONS

This application is a continuation of International Patent Application No. PCT/AU2020/050069, entitled "PHASE-STABILIZED AMMONIUM NITRATE PRILLS AND RELATED PRODUCTS AND METHODS", filed Feb. 3, 2020, and this application claims priority to Australian Provisional Patent Application No. 2019900348, entitled "PHASE-STABILIZED AMMONIUM NITRATE PRILLS", filed Feb. 5, 2019 and Australian Provisional Patent Application No. 2019904447, entitled "PHASE-STABILIZED AMMONIUM NITRATE PRILLS AND RELATED PRODUCTS AND METHODS", filed Nov. 25, 2019, the contents of each of which are hereby incorporated herein by reference in their entirety.

TECHNICAL FIELD

The present disclosure relates generally to explosives. More specifically, the present disclosure relates to phase-stabilized ammonium nitrate (PSAN) prill including ammonium nitrate and a potassium salt. The PSAN prill can be explosive grade and low density. The present disclosure also relates to methods of preparing the PSAN prill and related emulsions.

BRIEF DESCRIPTION OF THE DRAWINGS

The embodiments disclosed herein will become more fully apparent from the following description and appended claims, taken in conjunction with the accompanying drawings.

FIG. 12 depicts the results of crush strength testing for several exemplary samples.

FIG. 20A depicts the morphology and elemental mapping of the inside of an LDAN prill, analyzed by Scanning Electron Microscope with Energy Dispersive Spectroscopy (SEM-EDS). The left panel depicts the combined morphology and element mapping images. The upper right panel shows oxygen, nitrogen, and carbon elements detected by the element mapping analysis. The lower right panel depicts the morphology of the inside of the LDAN prill.

FIG. 20B panels from left to right, depicts the elemental mapping of oxygen, nitrogen, and carbon on the inside of an LDAN prill.

FIG. 22A depicts the morphology and elemental mapping of the outside of an LDAN prill, analyzed by Scanning Electron Microscope with Energy Dispersive Spectroscopy (SEM-EDS). The left panel depicts the combined morphology and element mapping images. The upper right panel shows oxygen, nitrogen, and carbon elements detected by the element mapping analysis. The lower right panel depicts the morphology of the outside of the LDAN prill.

FIG. 22B panels from left to right, depict the elemental mapping of oxygen, nitrogen, and carbon on the outside of an LDAN prill.

DETAILED DESCRIPTION

Figure 1:
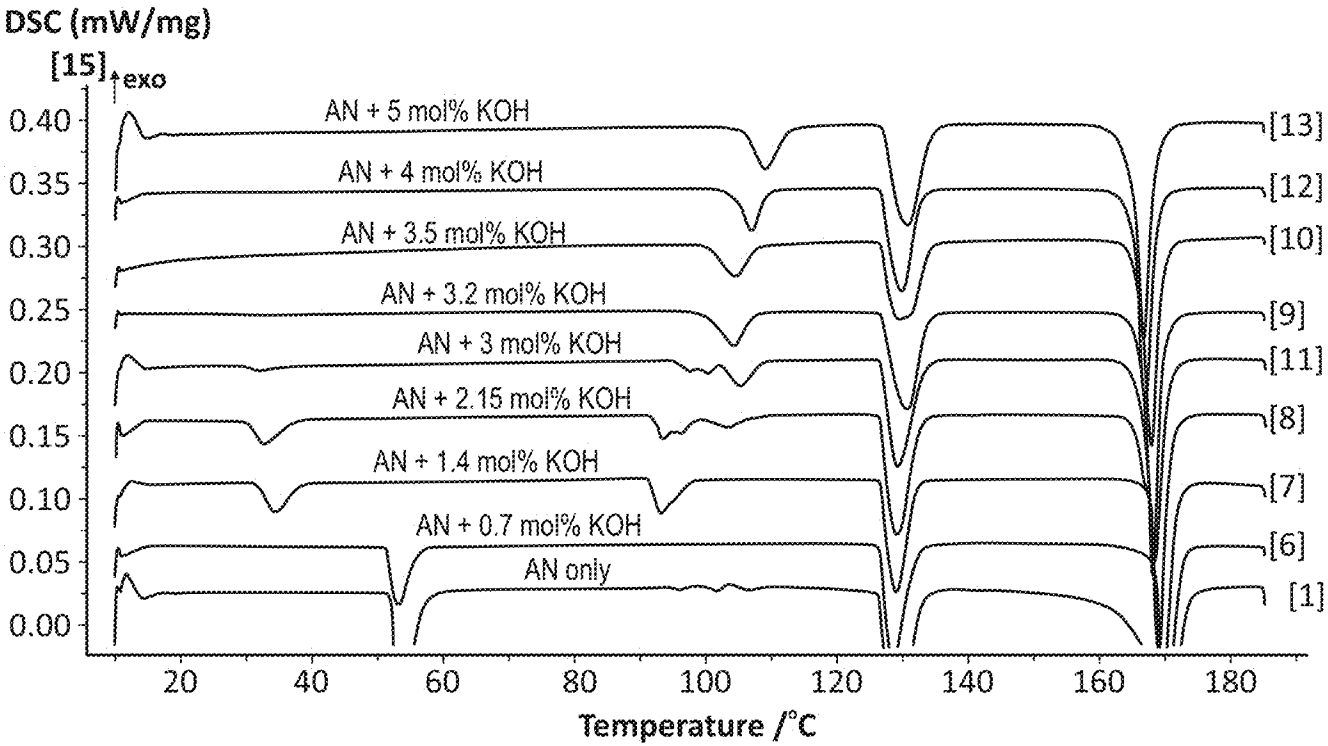
FIG. 1 is a graph showing differential scanning calorimeter (DSC) analysis of exemplary samples having various levels of potassium hydroxide (KOH) co-crystallized with ammonium nitrate (AN).

Phase-stabilized ammonium nitrate (PSAN) prill including ammonium nitrate and a potassium salt are disclosed herein, along with related methods. The PSAN prill can be explosive grade and low density. Furthermore, the PSAN prill may include a porosity enhancing agent such as an interfacial surface modifier or a pore former.

Thermal cycling of ammonium nitrate above and below about 32° C. results in crystal phase changes. Thermal cycling of AN prill results in expansion and contraction of the AN prill with each associated crystalline phase change. Crystalline phase changes of AN also occur at other temperatures as shown in Table 1.

TABLE 1

Crystalline Phases of AN

| System | Temperature (° C.) | State | Volume change (%) |
|---|---|---|---|
| | >169.6 | liquid | |
| I | 169.6 to 125.2 | cubic | −2.1 |
| II | 125.2 to 84.2 | tetragonal | +1.3 |
| III | 84.2 to 32.3 | α-rhombic | −3.6 |
| IV | 32.3 to −16.8 | β-rhombic | +2.9 |
| V | −16.8 | tetragonal | |

The mechanism of expansion and contraction of the AN prill can negatively impact the integrity and/or stability of the AN prill. For example, the expansion and contraction can result in: i) weakening of the AN prill; ii) an increase in AN fine formation (e.g., the AN prill may break down); iii) an increase in friability of the AN prill; and/or iv) an increase of moisture ingress into the AN prill. These characteristics or effects can contribute to caking of the AN prill, which can result in processing and handling problems, loss of free flow behavior, and/or out of specification product. The composition and methods provided herein can limit or inhibit weakening of prill, decrease fines formation, decrease friability, and/or decrease moisture ingress.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

As the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the embodiments described herein without departing from the underlying principles of the present disclosure.

PSAN prill as provided herein may exhibit significantly increased shelf life in comparison to standard low density ammonium nitrate (LDAN) prill, for example, during summer months when temperatures can frequently cycle above and below 32° C. Accordingly, the PSAN prill may be sent to or used in tropical regions and have increased shelf life compared to conventional LDAN. The PSAN prill may significantly reduce health, safety, and/or environmental risks associated with caked and/or blocky AN prill. The PSAN prill may negate the need for temperature controlled storage infrastructure (e.g., air conditioned AN bulk sheds). The PSAN prill may increase flexibility in planning for AN supply to customers. The PSAN prill may reduce or eliminate manufacturing bottle necks. Furthermore, the PSAN prill may be used in multiple markets (e.g., Asia Pacific and North America).

PSAN prill and methods of preparing PSAN prill are disclosed herein. It will be readily understood that the components of the embodiments as generally described below could be arranged and designed in a wide variety of different configurations. Thus, the following more detailed description of various embodiments, as described below and described in the Figures, is not intended to limit the scope of the disclosure, but is merely representative of various embodiments.

An aspect of the disclosure is directed to phase-stabilized ammonium nitrate (PSAN) prill. The PSAN prill can include ammonium nitrate and a potassium salt. In some embodiments, the PSAN prill may include from 0.5 mole percent (mol %) to 5 mol % potassium ions of the potassium salt based on the ammonium ions of the ammonium nitrate. In various embodiments, the mol % of the potassium ions based on the ammonium ions may be from 2 mol % to 5 mol %, 2 mol % to 4 mol %, 2.1 mol % to 4.0 mol %, or about 3 mol %. The PSAN prill can be explosive grade. In certain embodiments, the PSAN prill may be low density ("low density" prill has a bulk density of 0.84 kg/L or less).

"Explosive grade" AN prill has a minimum porosity of at least 5.7 FOR %. Explosive grade, low density AN (LDAN) prill is generally manufactured to include available and non-available porosity, such as by incorporation of a suitable porosity forming agent into the concentrated ammonium nitrate solution prior to prilling. Explosive grade prill is generally manufactured to include available and non-available porosity, that allows for the absorption of sufficient fuel oil so that the material may be detonated effectively. To determine if the porosity is suitable for manufacturing blasting agents, the ability of the prill to absorb diesel fuel oil is used. Functional determination of the porosity may be performed using a fuel oil retention test, in which a weighed quantity of AN prill is added to a weighed quantity of fuel oil and mixed for a specified time. Excess fuel oil is removed using absorbent paper tissue, the total mass of the formed ANFO product is recorded, and the % increase in mass calculated. The porosity of the PSAN prill as determined by fuel oil retention percent (FOR %) may be from 6 FOR % to 15 FOR %, 6 FOR % 12 FOR %, or 5.5 FOR % to 9 FOR %. It is often preferred that the porosity is such that the fuel oil absorption level is at least 5.7 FOR %, so that an acceptable oxygen balance is achieved when enough fuel oil is added to the PSAN prill to produce ANFO. Calculation of the total porosity, including non-available porosity, can be determined in a suitable fluid medium.

The following method may be used to measure FOR %, which correlates to the porosity of prilled ammonium nitrate. The method measures the increase in mass of a selected sample of prill after total immersion in diesel fuel oil (DFO) and removal of excess DFO using paper towel. This method can be a quality check used in product raw material evaluation. First, 40 g (+−0.05 g) sample of AN prill (fines removed) can be weighed into a labelled and tared 250 mL screw top sample jar. This is recorded as the 'Initial Weight'. Then 6.5 mL of DFO can be added and distributed evenly over the sample. The lid is tightly screwed closed and can be shaken vigorously for 30 seconds. The sample jar can then be placed on the bottle roller and the machine operated for 20 minutes at 40 rpm. After 20 minutes, the jar can be tapped on the bench to remove prill stuck to the lid. Two strips of blotting paper can be placed: one wound loosely to fit along the sides of the jar; the second strip wound tightly and inserted into the center of the first strip of blotting paper. The lid can be replaced, then the jar shaken by hand for 3 minutes. The prill should roll freely in the jar. The sample jar can be placed on the bottle roller and the machine operated for 15 minutes at 40 rpm. The prill should spread out evenly along the length of the jar, and the roller can be adjusted to achieve this. The absorbent paper strips can then carefully be removed, ensuring no prill is removed from the jar. The prill can be transferred to a tared 100 mL beaker and weighed to the nearest 0.05 g. This is recorded as the 'Final Weight'. The % Fuel Oil Retention (FOR) can be calculated as follows:

$$\text{FOR (\%)}=((\text{Final Weight}-\text{Initial Weight})/\text{Final Weight})\times 100$$

In some embodiments, the PSAN prill may include a porosity enhancing agent. The porosity enhancing agent may include an interfacial surface modifier and/or a pore former. The interfacial surface modifier may be selected from at least one of an alkyl sulfonate polymer, an alkaline metal or ammonium salt of naphthalenesulfonic acid, an alkaline metal salt of alkyl sulfonic acid, an alkaline metal salt of polystyrene sulfonic acid, aluminum sulfate hydrate, an alkaline metal salt of a copolymer of naphthalene sulfonate and formaldehyde, and combinations thereof.

In certain embodiments, the interfacial surface modifier may be an alkyl sulfonate polymer selected from at least one of sodium naphthalene sulfonate, sodium naphthalene-co-formaldehyde copolymer, or both. In various embodiments, the interfacial surface modifier may be an alkaline metal salt, such as sodium or potassium, or an ammonium salt of naphthalenesulfonic acid. The interfacial surface modifier may also be a crystal habit modifier.

In certain embodiments, the concentration of the interfacial surface modifier may be from 400 ppm to 4,000 ppm, such as, for example, from 400 ppm to 1000 ppm, from 500 ppm to 900 ppm, from 600 ppm to 800 ppm, or about 700 ppm, or such as, for example, from 2,000 ppm to 4,000 ppm, from 2,500 ppm to 3,900 ppm, from 3,000 ppm to 3,700 ppm, or about 3,500 ppm.

The pore former may be selected from at least one of chalk, linear alkylbenzene sulfonate, sulfonic acid, monoalkylphenols ether, dialkylhydroxylamines ether, and combinations thereof.

The potassium salt may be any potassium salt, such as selected from at least one of potassium hydroxide, potassium nitrate, potassium sulfate, potassium hydrogen sulfate, potassium carbonate, and potassium hydrogen carbonate. In some embodiments, the potassium may be selected from at least one of potassium hydroxide, potassium nitrate, and potassium sulfate.

In some embodiments, the PSAN prill may include from 0.5 mol % to 5 mol % potassium ions of potassium hydroxide based on the ammonium ions of the ammonium nitrate (which corresponds to a weight percent (wt %) of 0.4 wt % to 4 wt % potassium hydroxide based on the ammonium nitrate). In various embodiments, the mol % of the potassium ions based on the ammonium ions may be from 2 mol % to 5 mol % (about 1.5 wt % to 4 wt % potassium hydroxide), 2 mol % to 4 mol % (about 1.5 wt % to 3 wt % potassium hydroxide), 2.1 mol % to 4.0 mol % (about 1.5 wt % to 3 wt % potassium hydroxide), or about 3 mol % (about 2 wt % potassium hydroxide).

In certain embodiments, the PSAN prill may include from 0.5 mol % to 5 mol % potassium ions of potassium nitrate based on the ammonium ions of the ammonium nitrate (1 wt % to 6 wt % potassium nitrate based on the ammonium nitrate). In various embodiments, the mol % of the potassium ions based on the ammonium ions may be from 2 mol % to 5 mol % (about 3 wt % to 6 wt % potassium nitrate), 2 mol % to 4 mol % (about 3 wt % to 5 wt % potassium nitrate), 2.1 mol % to 4.0 mol % (about 3 wt % to 5 wt % potassium nitrate), or about 3 mol % (about 4 wt % potassium nitrate).

In various embodiments, the PSAN prill may include from 0.5 mol % to 5 mol % potassium ions of potassium sulfate based on the ammonium ions of the ammonium nitrate (1 wt % to 10 wt % potassium sulfate based on the ammonium nitrate). In various embodiments, the mol % of the potassium ions based on the ammonium ions may be from 2 mol % to 5 mol % (about 5 wt % to 10 wt % potassium sulfate), 2 mol % to 4 mol % (about 5 wt % to 8 wt % potassium sulfate), 2.1 mol % to 4.0 mol % (about 5 wt % to 8 wt % potassium sulfate), or about 3 mol % (about 6 wt % potassium sulfate).

In some embodiments, the bulk density of the PSAN prill may be less than 0.9 kg/L. Furthermore, the PSAN prill may lack, or substantially lack, a 32° C. crystalline phase change. Alternatively, the 32° C. crystalline phase change may be shifted to a temperature higher than 50° C. The PSAN prill may lack, or substantially lack, an 84° C. crystalline phase change. In certain embodiments, the presence of the 32° C. crystalline phase change and/or the 84° C. crystalline phase change may be determined by thermal analysis and/or x-ray diffraction measurements. For example, the thermal analysis may include DSC analysis and/or TGA analysis. "Substantial lack" of a 32° C. phase change may correspond to a sufficient removal of the phase change that the PSAN prill can be thermally cycled 50 times and stay within customer specifications, such as the specifications listed in Table 2.

In various embodiments, upon thermal cycling the PSAN prill 50 times, the thermal cycled PSAN prill may have an average crush strength greater than 0.4 kg, such as from 0.4 kg to 2.0 kg, 0.5 kg to 1.5 kg, 0.6 kg to 1.0 kg, or 0.7 kg to 0.9 kg. One cycle can include exposing the PSAN prill to 15° C. for four hours followed by four hours at 45° C.

In some embodiments, upon thermal cycling the PSAN prill 20 times (the "test PSAN prill"), an average crush strength of the thermal cycled PSAN prill may be greater than the average crush strength of non-thermal cycled control PSAN prill. One cycle includes exposing the PSAN prill to 15° C. for four hours followed by four hours at 45° C. The test PSAN prill and the control PSAN prill include the same components; however, while the test PSAN prill is subjected to thermal cycling, the control PSAN prill is not subjected to thermal cycling.

The average crush strength of the thermal cycled PSAN prill may be from 5% to 100% greater than the average crush strength of the non-thermal cycled control PSAN prill. In certain embodiments, the average crush strength of the thermal cycled PSAN prill may be from 10% to 80%, 20% to 60%, or 25% to 40% greater than the average crush strength of the non-thermal cycled control PSAN prill. Thus, thermal cycling can be used to increase the hardness of low density, explosive grade, PSAN prills.

Crush strength may be determined by the following method. All equipment including gloves should be dry and the samples sealed in an air tight container when stored. Samples are prepared by first weighing 250 g of AN prill final product sample and transferring to the top of a sieve stack consisting of a 2.36 mm sieve, 2.00 mm sieve, and a collection pan. The samples and the sieve stack are placed in a sieve shaker for 10 mins with an amplitude setting of 60. The fines in the receiving pan and the oversized in the 2.36 mm sieve are discarded. A fraction of the sample from the 2.00 mm sieve is taken to be used for crush testing. For the crush test, 20 individual AN prills from the 2.00 mm sieve are randomly selected. A crush test apparatus comprising a force gauge meter (such as model M5-5) and a test stand stage (such as a motorized test stand ESM301L) is used to record KgF units. A prill is placed in the center of the test stand stage. The force gauge meter is zeroed out. The force gauge piston is lowered to crush the test prill. After the force gauge is fully extended, the applied force is recorded as the crush resistance. This process is performed for each of the 20 prills. Crush resistance is calculated as the average crush resistance of the 20 prills.

The shelf life of the PSAN prill as provided herein may be at least six months. For example, the PSAN prill may have a shelf life of up to six months or more (such as at least two months, at least four months, or at least six months) while being stored during a hot summer period with an average daytime ambient temperature from 30° C. to 50° C. and average night time temperature of 10° C. to 30° C. By contrast, the shelf life of conventional LDAN prill, without the aid of temperature controlled storage, would be much less.

The PSAN prill may have crystal domains that are more tightly packed and more uniform than the crystal domains of an explosive grade ammonium nitrate prill devoid of potassium. Without wishing to be bound by theory, the more tightly packed crystal domains of the PSAN prill may contribute to the improved hardness of the PSAN prill, as compared to conventional LDAN prill. Without wishing to be bound by theory, it is believed that a combination of potassium and a porosity enhancing agent may contribute to the more tightly packed and more uniform crystal domains of the PSAN prill. Thus, the combination of potassium and a porosity enhancing agent may contribute to the surprisingly increased crush strength of the PSAN prills, all while maintaining the porosity and low density of the prills. The crystal domains may be determined by Scanning Electron Microscope with Energy Dispersive Spectroscopy (SEM-EDS).

The PSAN prill may have potassium uniformly distributed throughout the prill. When the PSAN prill includes an interfacial surface modifier containing an alkyl group (such as part of a polymer), then the PSAN prill may have carbon uniformly distributed throughout the prill.

Another aspect of the disclosure is directed to methods of preparing a PSAN prill. The method may include forming a PSAN solution comprising a potassium salt and ammonium nitrate and crystallizing the PSAN solution to form a PSAN prill. The PSAN prill may be explosive grade and low density. The method may further include combining a porosity enhancing agent with the PSAN solution. Forming the PSAN solution may include mixing a potassium salt with nitric acid and reacting the mixture with ammonia to form the PSAN solution, such as in a neutralizer. For example, the potassium salt may be mixed with the nitric acid immediately prior to introducing the mixture into the neutralizer or the potassium salt may be separately introduced into the neutralizer. Alternatively, the potassium salt could be added post-neutralizer, as a liquid or even as a solid, such as to either the remelt tank or the head tank of a plant. This would require alterations to most plants and possibly even a second neutralizer plus an evaporator/flash drum and a second product stream. Generally speaking, it may be possible to add the potassium salt at a variety points on the wet-side of a prill plant (i.e., at a point in the process pre-solid prill formation).

Any combination of the components and the amounts or concentrations thereof described in reference to the PSAN prill as provided above may also be incorporated into the methods of preparing the PSAN prill. Furthermore, any of the characteristics or measurements of the PSAN prill as provided above (e.g., bulk density, average crush strength, and shelf life) may also be applicable to the PSAN prill prepared by the disclosed methods.

Another aspect of the disclosure is directed to methods of increasing the hardness (e.g., the average crush strength) of a PSAN prill. The method may include forming a PSAN solution comprising a potassium salt and ammonium nitrate and crystallizing the PSAN solution to form a PSAN prill.

In some embodiments, upon thermal cycling the PSAN prill 20 times, an average crush strength of the thermal cycled PSAN prill may be greater than the average crush strength of non-thermal cycled control PSAN prill. One cycle may include exposing the PSAN prill to 15° C. for four hours followed by four hours at 45° C.

The average crush strength of the thermal cycled PSAN prill may be from 25% to 100% greater than the average crush strength of the non-thermal cycled control PSAN prill. In certain embodiments, the average crush strength of the thermal cycled PSAN prill may be from 35% to 90%, 45% to 80%, or 55% to 70% greater than the average crush strength of the non-thermal cycled control PSAN prill.

Another aspect of the disclosure is directed to an emulsion explosive comprising a discontinuous oxidizer phase comprising a remelt of any embodiments of the PSAN prill disclosed herein.

Another aspect of the disclosure is directed to an emulsion explosive comprising at least (a) a discontinuous oxidizer phase comprising ammonium nitrate and from 0.5 mole percent (mol %) to 5 mol % potassium ions based on the ammonium ions of the ammonium nitrate and (b) a continuous fuel phase.

Examples of the continuous fuel phase include, but are not limited to, liquid fuels such as fuel oil, diesel oil, distillate, furnace oil, kerosene, gasoline, and naphtha; waxes such as microcrystalline wax, paraffin wax, and slack wax; oils such as paraffin oils, benzene, toluene, and xylene oils, asphaltic materials, polymeric oils such as the low molecular weight polymers of olefins, animal oils, such as fish oils, and other mineral, hydrocarbon or fatty oils; and mixtures thereof. Any fuel phase known in the art and compatible with the oxidizer phase and an emulsifier, if present, may be used.

Likewise, another aspect of the disclosure is directed to an emulsion explosive blend comprising an emulsion explosive and any embodiments of the PSAN prill disclosed herein, blended with the emulsion explosive.

Another aspect of the disclosure is directed to a method of making an emulsion explosive, the method comprising: melting PSAN prill into a liquor, the liquor comprising ammonium nitrate; and a potassium salt, wherein the PSAN prill comprises from 0.5 mole percent (mol %) to 5 mol % potassium ions of the potassium salt based on the ammonium ions of the ammonium nitrate. The method further may include forming the liquor into a discontinuous oxidizer phase of an emulsion. The emulsion may be sensitized as needed to form an emulsion explosive.

Any combination of the components and the amounts or concentrations thereof described in reference to the PSAN prill or methods of preparing the PSAN prill as provided above may also be incorporated into the methods of increasing the hardness of the PSAN prill. Furthermore, any of the characteristics or measurements of the PSAN prill as provided above may also be applicable to the PSAN prill prepared by the methods of increasing the hardness of the PSAN prill.

EXAMPLES

The following examples are illustrative of disclosed methods and compositions. In light of this disclosure, those of skill in the art will recognize that variations of these examples and other examples of the disclosed methods and compositions would be possible without undue experimentation.

Example 1—Generation of Prilloids for Analysis

To generate the prilloids, the following method was used. 2.8 mm diameter holes were drilled into the top of a 5 mm thick TEFLON™ plate to a depth of approximately 3 mm. 0.9 mm diameter drainage holes were drilled into those holes. AN solution was then added to the plate to fill the 2.8 mm holes. Once the prilloids cooled, they were pushed out of the 2.8 mm holes in the TEFLON™ plate via the drainage holes.

Example 2—DSC Analysis of Prilloids

Once prilloids were generated, multiple different formulations of AN and potassium ions were manufactured. These ranged from AN only (no potassium present) up to 5 mol % potassium hydroxide (KOH) co-crystallized with ammonium nitrate, or up to 25 mol % potassium nitrate ($KNO_3$) co-crystallized with ammonium nitrate. Specifically, the following KOH prilloid formulations were generated and tested: a) AN only, b) AN and 0.7 mol % KOH, c) AN and 1.4 mol % KOH, d) AN and 2.15 mol % KOH, e) AN and 3 mol % KOH, f) AN and 3.2 mol % KOH, g) AN and 3.5 mol % KOH, h) AN and 4 mol % KOH, and i) AN and 5 mol % KOH. The following $KNO_3$ prilloid formulations were generated and tested: a) AN only, b) 1 mol % $KNO_3$, c) 2 mol % $KNO_3$, d) 3 mol % $KNO_3$, e) 3.5 mol % $KNO_3$, f) 4 mol % $KNO_3$, g) 5 mol % $KNO_3$, h) 10 mol % $KNO_3$, i) 15 mol % $KNO_3$, j) 20 mol % $KNO_3$, k) 25 mol % $KNO_3$, and l) pure $KNO_3$.

Figure 14:
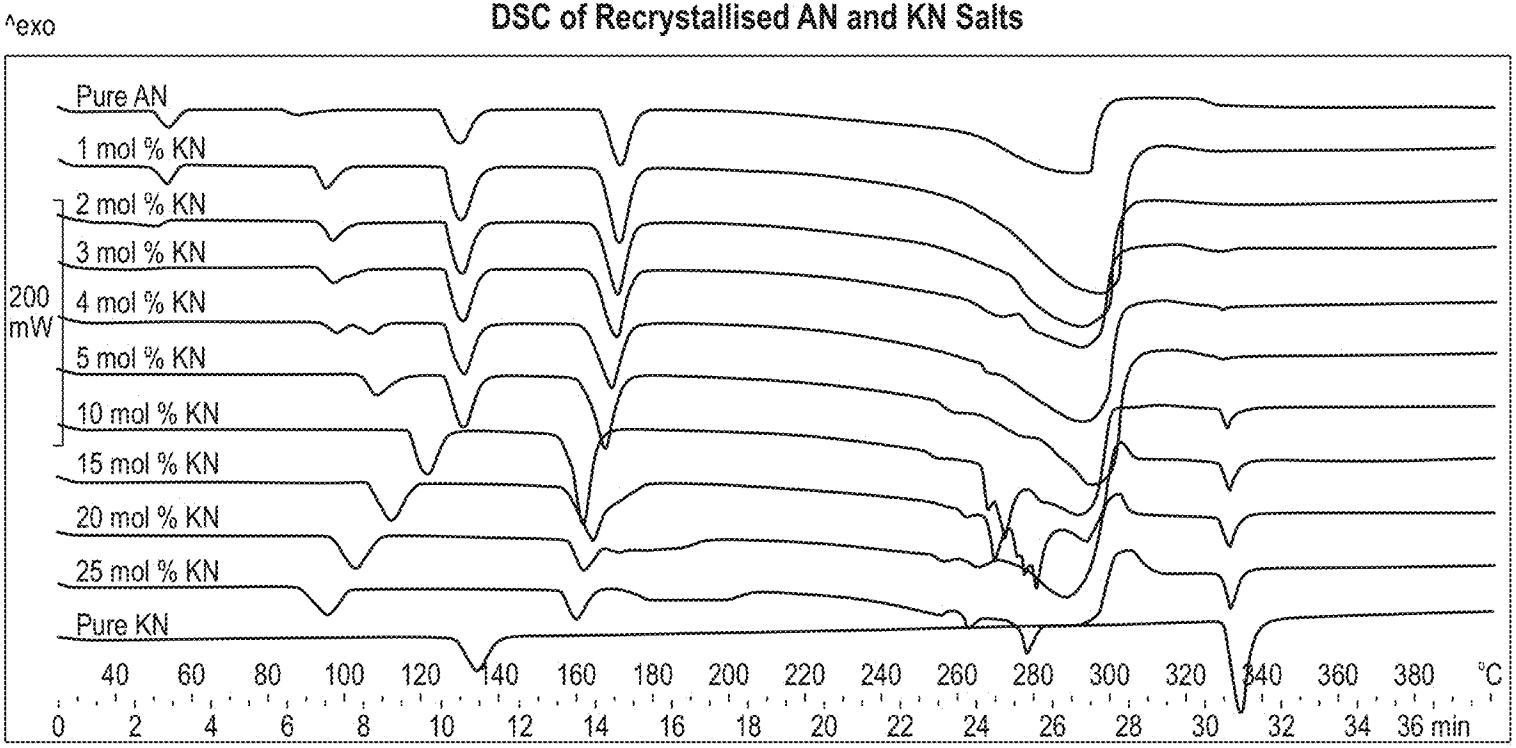
FIG. 14 is a graph showing DSC analysis of exemplary samples having various levels of potassium nitrate (KN or $KNO_3$) co-recrystallized with ammonium nitrate (AN).

These samples were then analyzed via DSC using a NETZSCH™ DSC 214 Polyma. It was demonstrated that at 5 mol % of potassium ion present in ammonium nitrate, the 32° C. phase change in the ammonium nitrate was eliminated. Furthermore, amounts as low as 3.2 mol % KOH co-crystallized with ammonium nitrate also exhibited elimination of the 32° C. phase change (see FIG. 1). Formation of mixed nitrate salts of structural form, $K_x(NH_4)_{1-x}NO_3$, and elimination of the 32° C. phase change were observed, depending on the mol % of $KNO_3$ (see FIG. 14).

Example 3—Analysis of Various Potassium Salts

Prilloids were manufactured that included GALORYL® AT ("GAL") in addition to AN and/or a potassium salt. GALORYL® AT was added to multiple formulations at a level of 700 ppm. The key component of GALORYL® AT is sodium naphthalene sulfonate (co-formaldehyde polymer). Thus, GALORYL® AT is an exemplary interfacial surface modifier. Also, multiple types of potassium salt were tested. Multiple potassium salts were tested, for example, to: a) determine if different potassium salts, at approximately the same level of potassium ion present in the formulation, would work, and/or b) create options for choice of potassium salts (e.g., due to cost and/or ease of introduction of a given potassium salt into a given plant process).

The following samples were prepared for analysis: 1) low density AN (LDAN), 2) AN only, 3) AN and 700 ppm GALORYL® AT, 4) AN and 700 ppm GALORYL® AT and 3.5 mol % $KNO_3$, 5) AN, 700 ppm GALORYL® AT, and 3.5 mol % KOH, and 6) AN, 700 ppm GALORYL® AT, and 3.3 mol % $K_2SO_4$. Throughout the manufacture of the prilloids and analysis of the various formulations, it was demonstrated via DSC that as low as 3.2 mol % of potassium ion present eliminated the 32° C. phase change.

Example 4—Thermal Analysis of Prilloids

Figure 2:
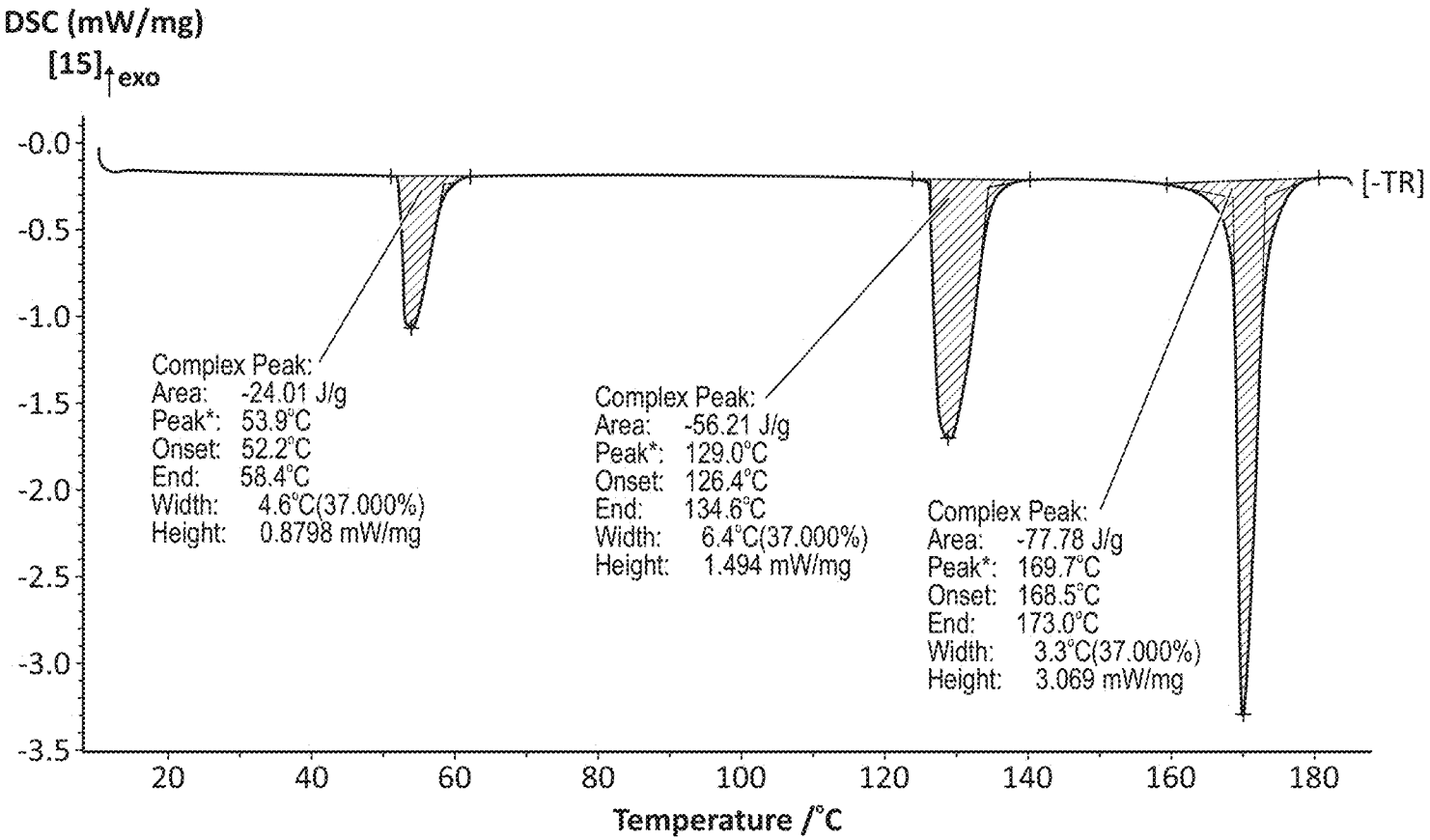
FIG. 2 is a graph showing DSC analysis of a sample having AN only.
Figure 3:
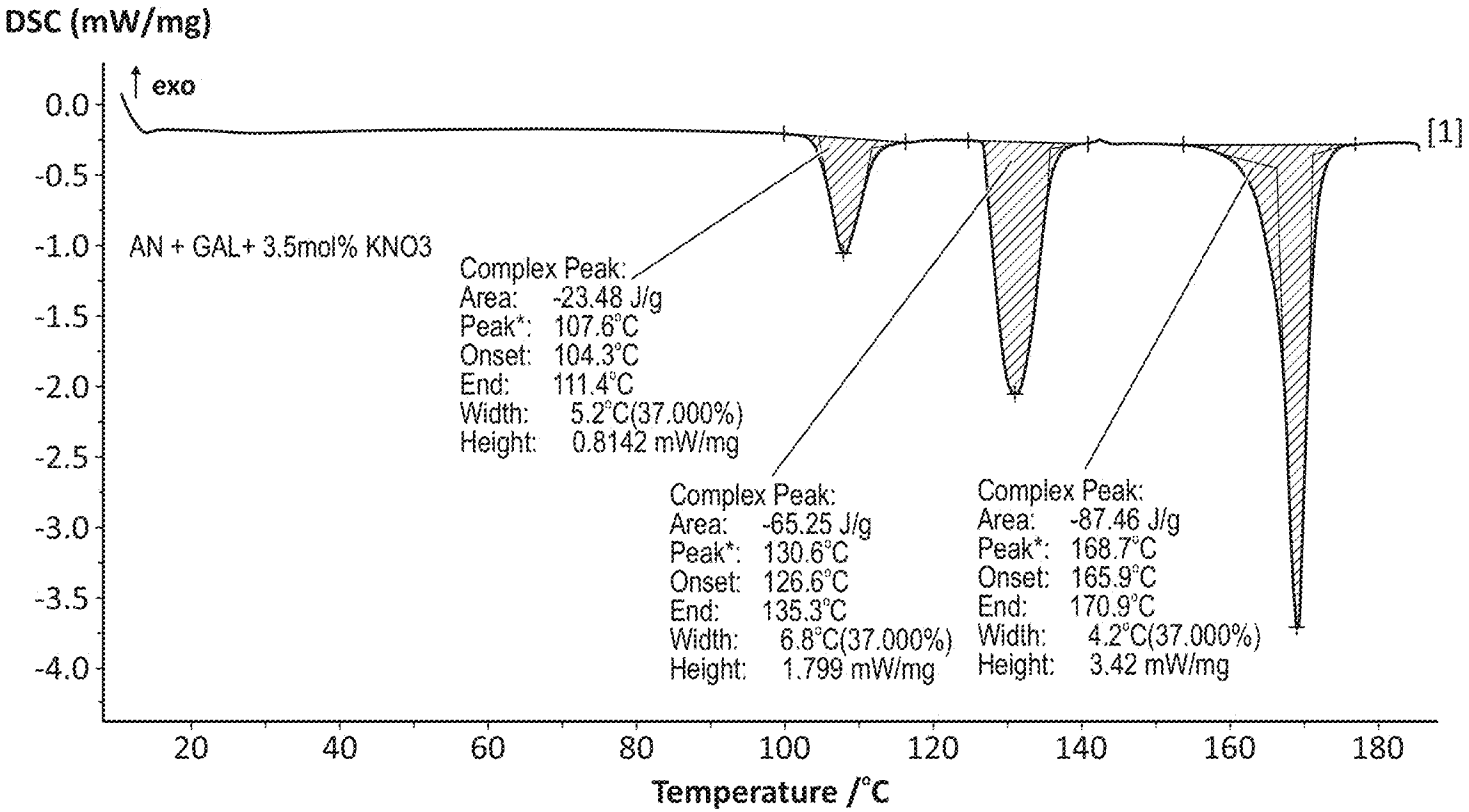
FIG. 3 is a graph showing DSC analysis of an exemplary sample having AN, 700 ppm GALORYL® AT (ARRMAZ™) (referred to as "GAL"), and 3.5% $KNO_3$.
Figure 4:
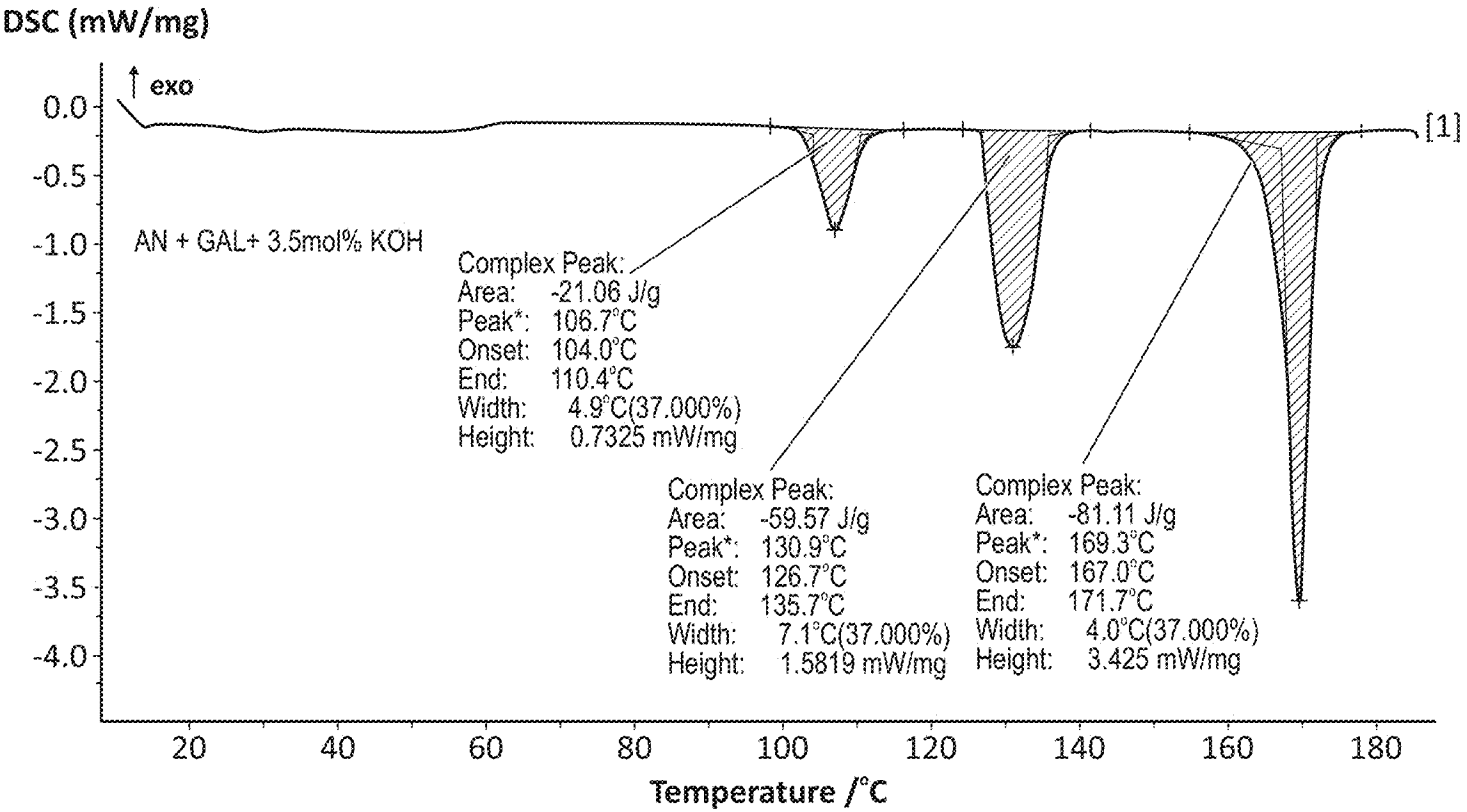
FIG. 4 is a graph showing DSC analysis of an exemplary sample having AN, 700 ppm GALORYL® AT, and 3.5 mol % KOH.
Figure 5:
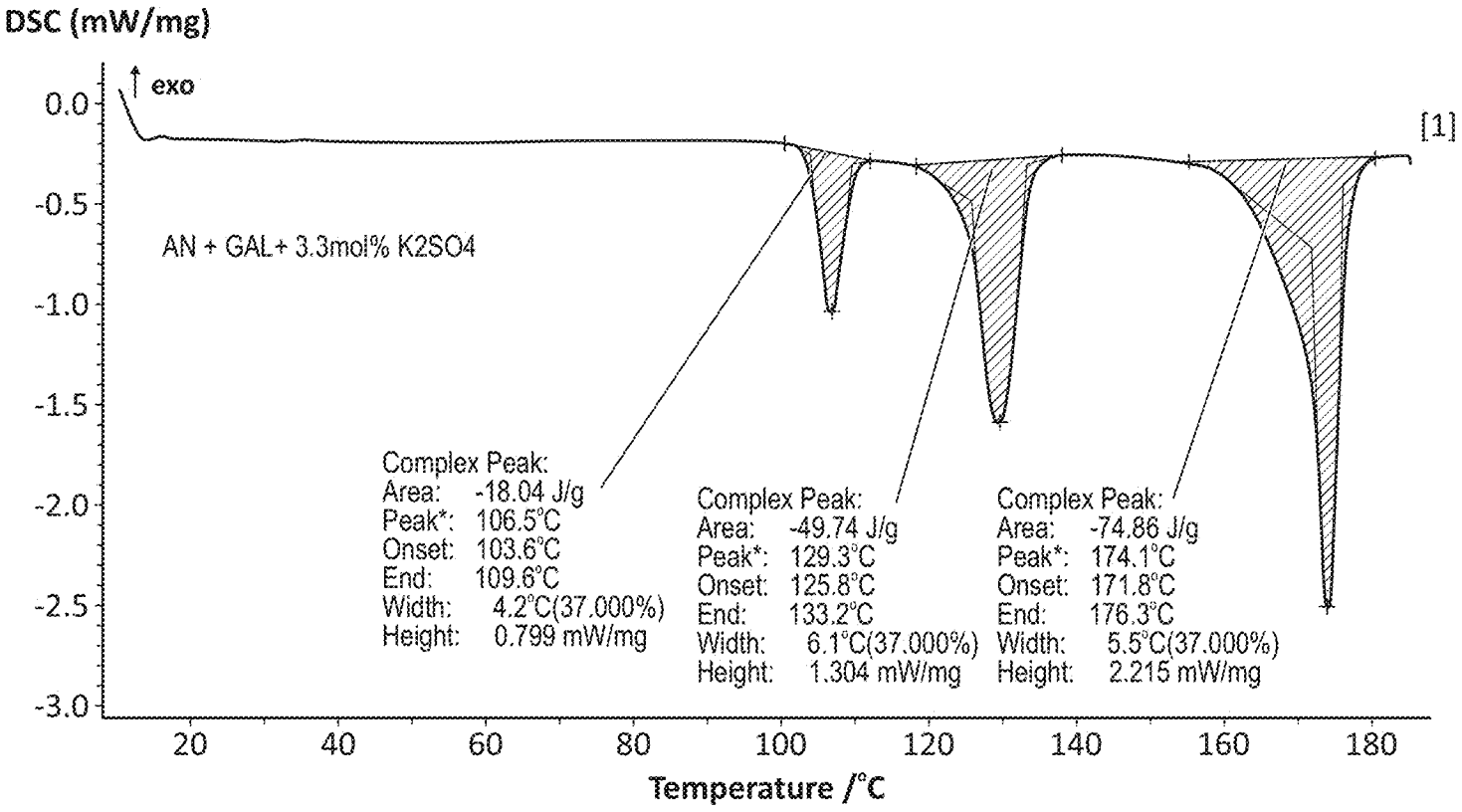
FIG. 5 is a graph showing DSC analysis of an exemplary sample having AN, 700 ppm GALORYL® AT, and 3.3 mol % $K_2SO_4$.

Prilloids of the various formulations generated above were then analyzed using a DSC (NETZSCH™ DSC 214 Polyma) and a TGA (NETZSCH™ TG 209 F3 TARSUS®). DSC analysis confirmed that the 32° C. phase change for ammonium nitrate was eliminated, with both potassium salts and GALORYL® AT present. This is compared to the analysis of AN only, which demonstrated the presence of the 32° C. crystalline phase change (see FIG. 2, AN only; FIG. 3, AN, GALORYL® AT (700 ppm), and 3.5% $KNO_3$; FIG. 4, AN, GALORYL® AT (700 ppm), and 3.5 mol % KOH; and FIG. 5, AN, GALORYL® AT (700 ppm), and 3.3 mol % $K_2SO_4$).

Figure 6:
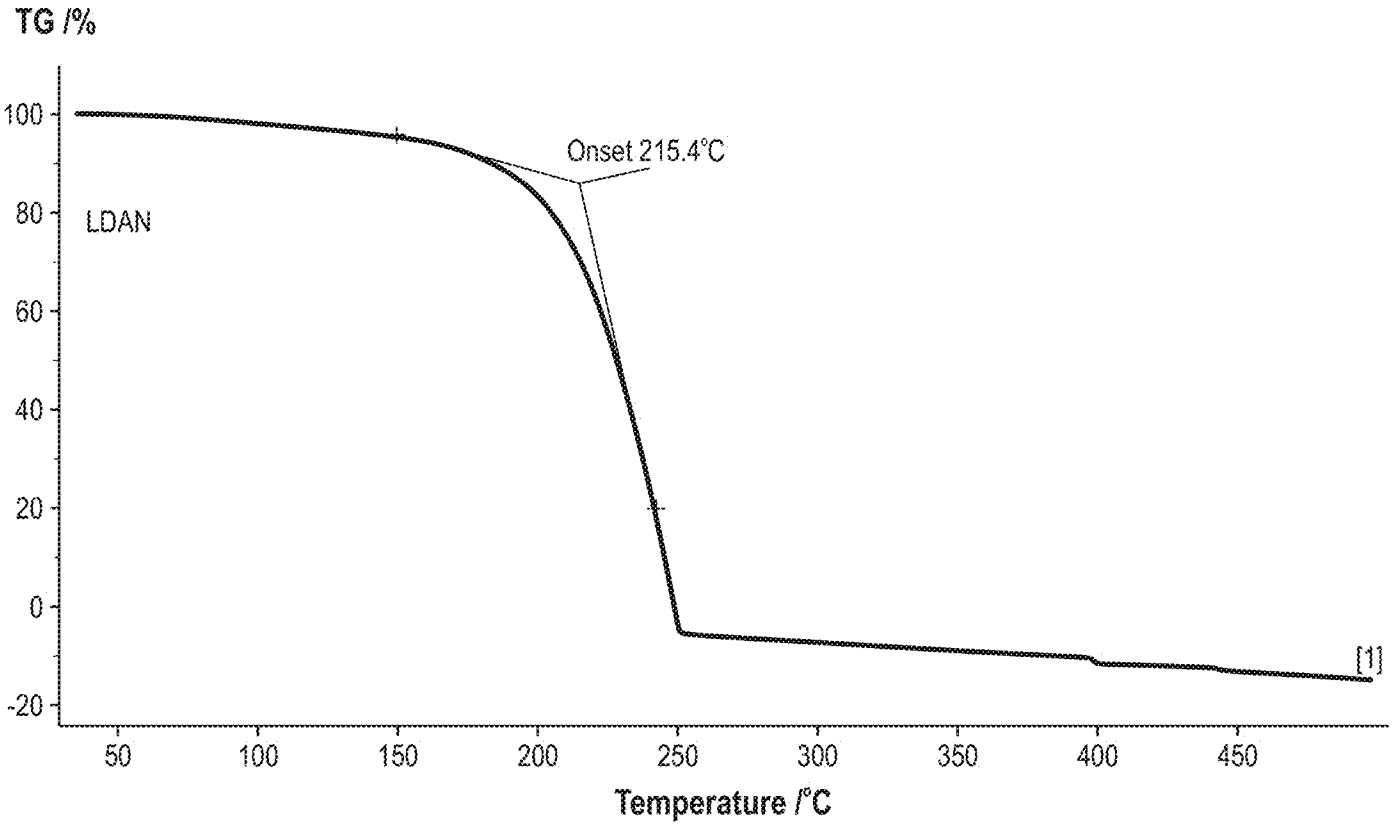
FIG. 6 is a graph showing thermogravimetric analyzer (TGA) analysis of a sample having AN only.
Figure 7:
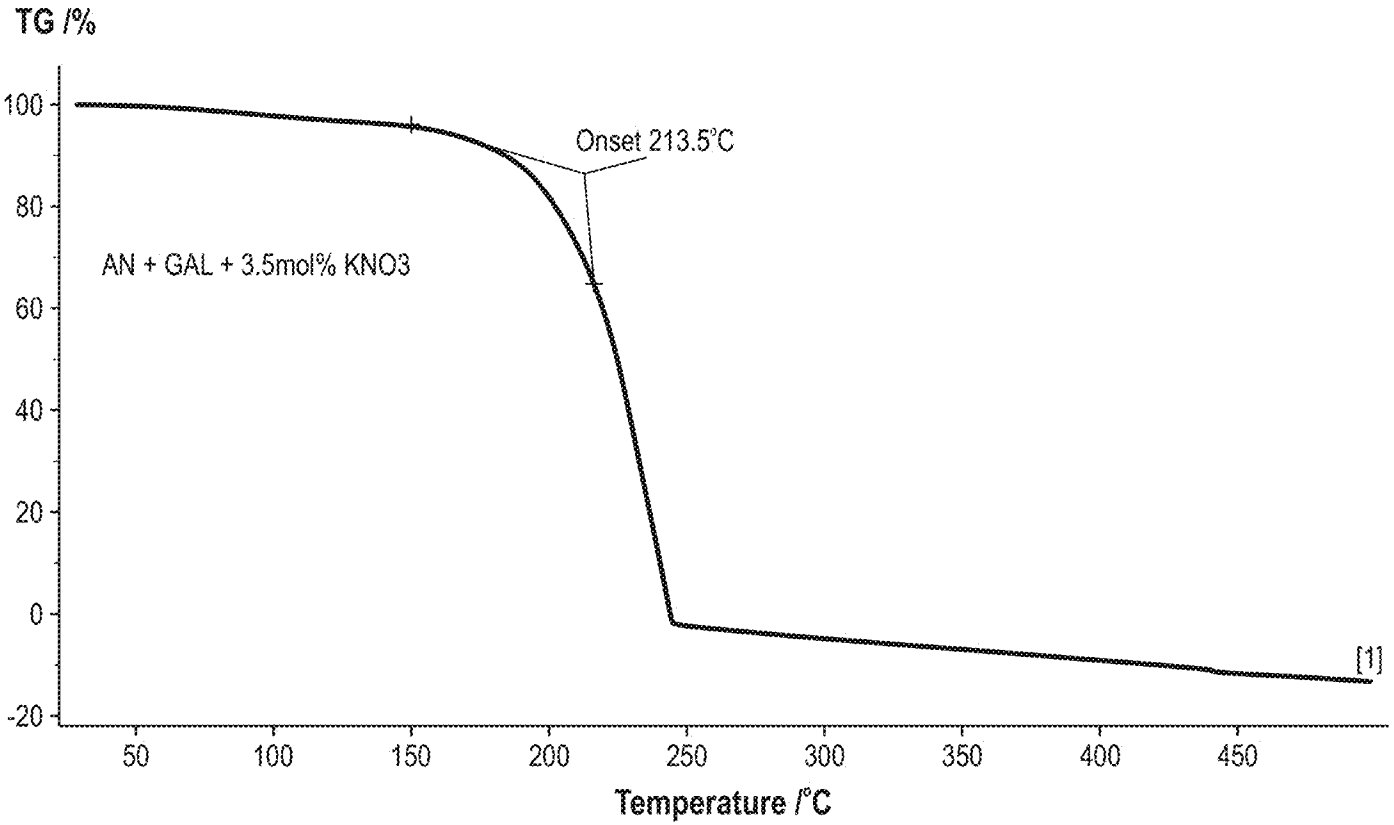
FIG. 7 is a graph showing TGA analysis of an exemplary sample having AN, 700 ppm GALORYL® AT, and 3.5% $KNO_3$.
Figure 8:
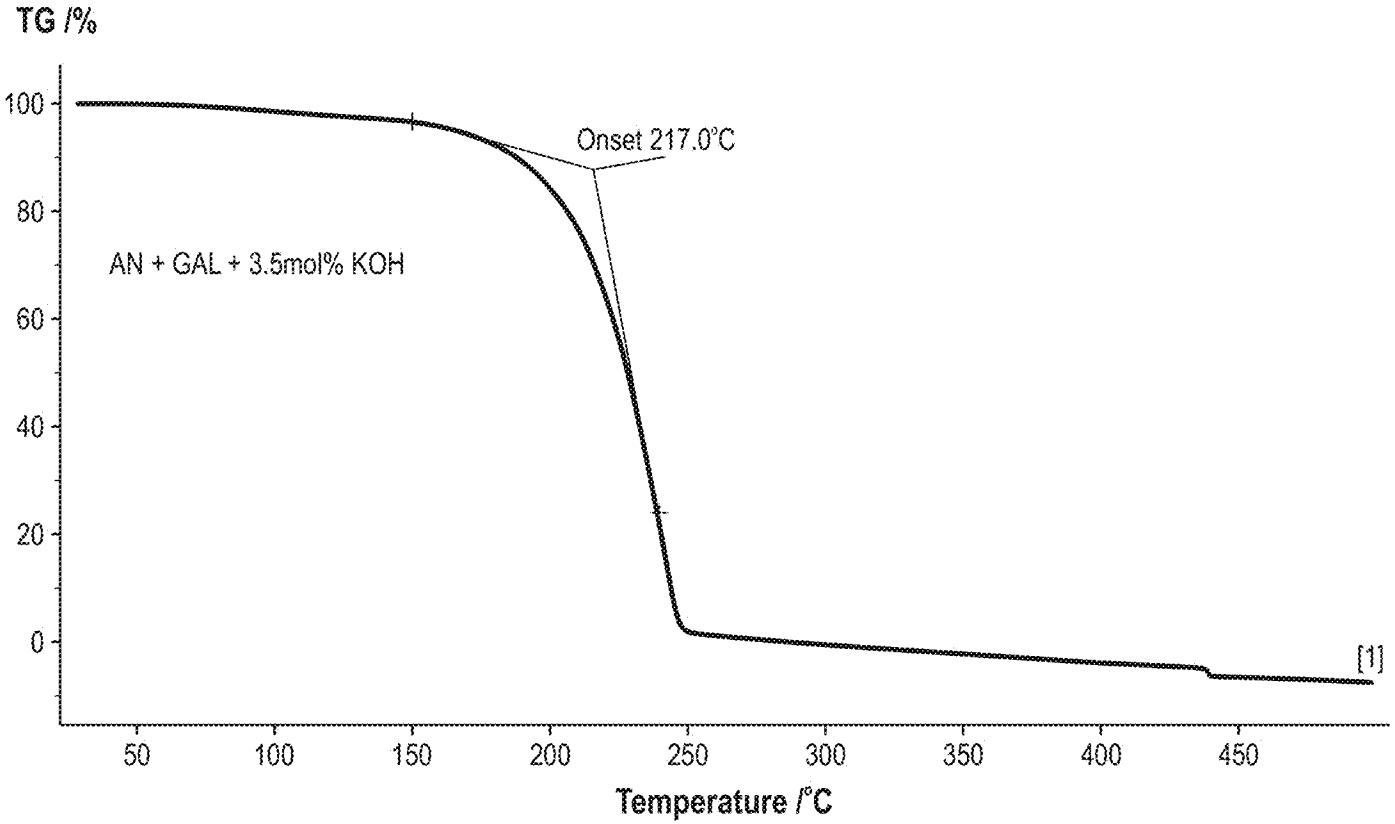
FIG. 8 is a graph showing TGA analysis of an exemplary sample having AN, 700 ppm GALORYL® AT, and 3.5 mol % KOH.
Figure 9:
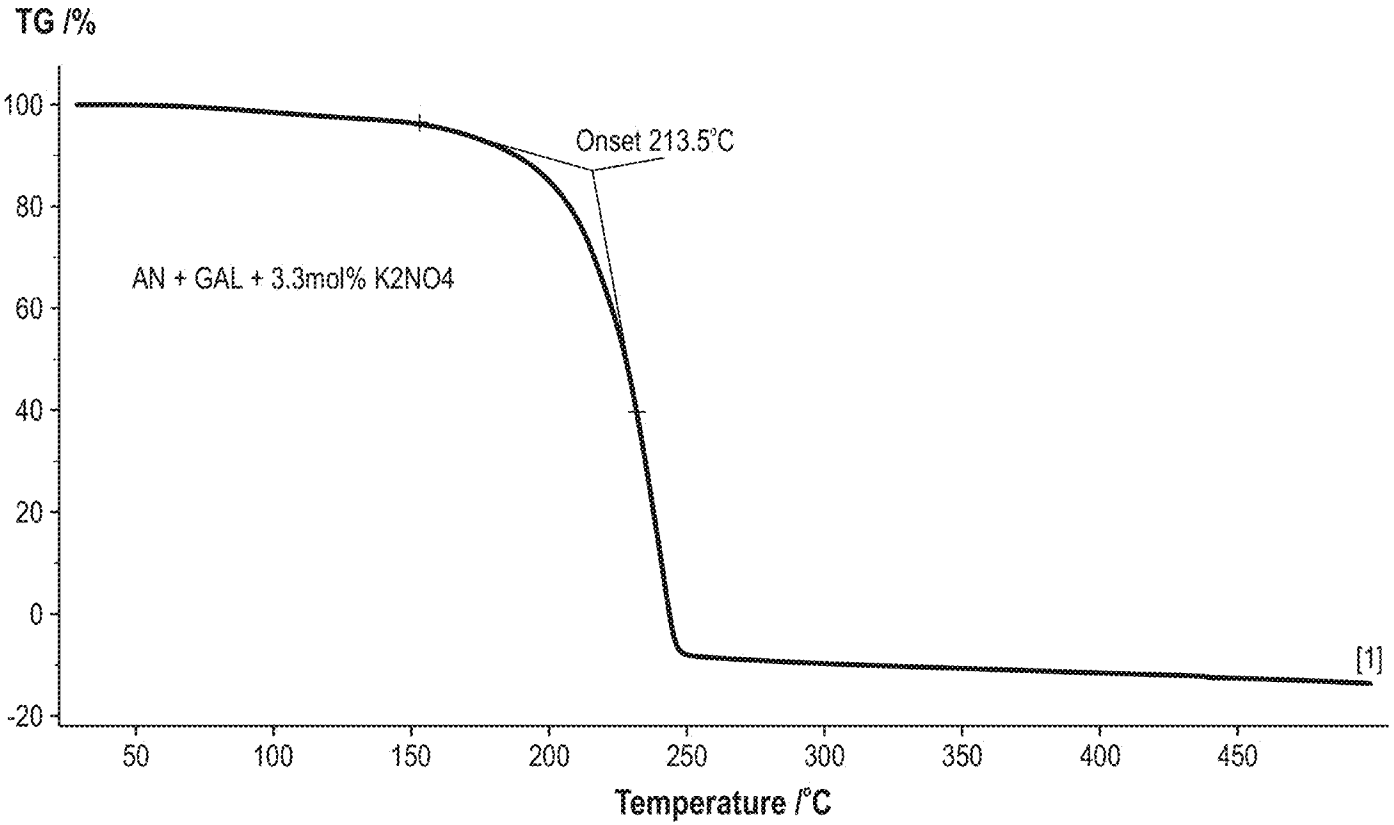
FIG. 9 is a graph showing TGA analysis of an exemplary sample having AN, 700 ppm GALORYL® AT, and 3.3 mol % $K_2SO_4$.

TGA analysis was also performed on the various formulations. The point of decomposition (onset) for pure ammonium nitrate is at about 210-212° C. It was demonstrated with the various formulations that the point of decomposition was not significantly different compared to standard LDAN product (see FIG. 6, AN only; FIG. 7, AN, GALORYL® AT (700 ppm), and 3.5% $KNO_3$; FIG. 8, AN, GALORYL® AT (700 ppm), and 3.5 mol % KOH; and FIG. 9, AN, GALORYL® AT (700 ppm), and 3.3 mol % $K_2SO_4$).

Example 5—Thermal Cycling and Crush Testing of Prilloids

The six samples described in Example 3 were placed into a cycling oven (PANASONIC™ MIR-254 Cooled Incubator). The cycling oven was designed to mimic the thermal cycling that occurs in the field. The oven was set such that one cycle included a four-hour period at 15° C. followed by a four-hour period at 45° C. The samples were cycled a total of 200 times.

Throughout the cycling process, the condition and possible degradation of the samples was visually observed. Also, crush testing was performed at various points to demonstrate possible changes in hardness of the samples throughout the cycling process (using a Mark-10 ESM303 Motorised Test Stand and Mark-10 Digital Force Gauge M5-20).

Samples were tested for crush strength (hardness) throughout the process of thermal cycling. Crush testing was performed at the points indicated in FIG. 12.

Figure 13:
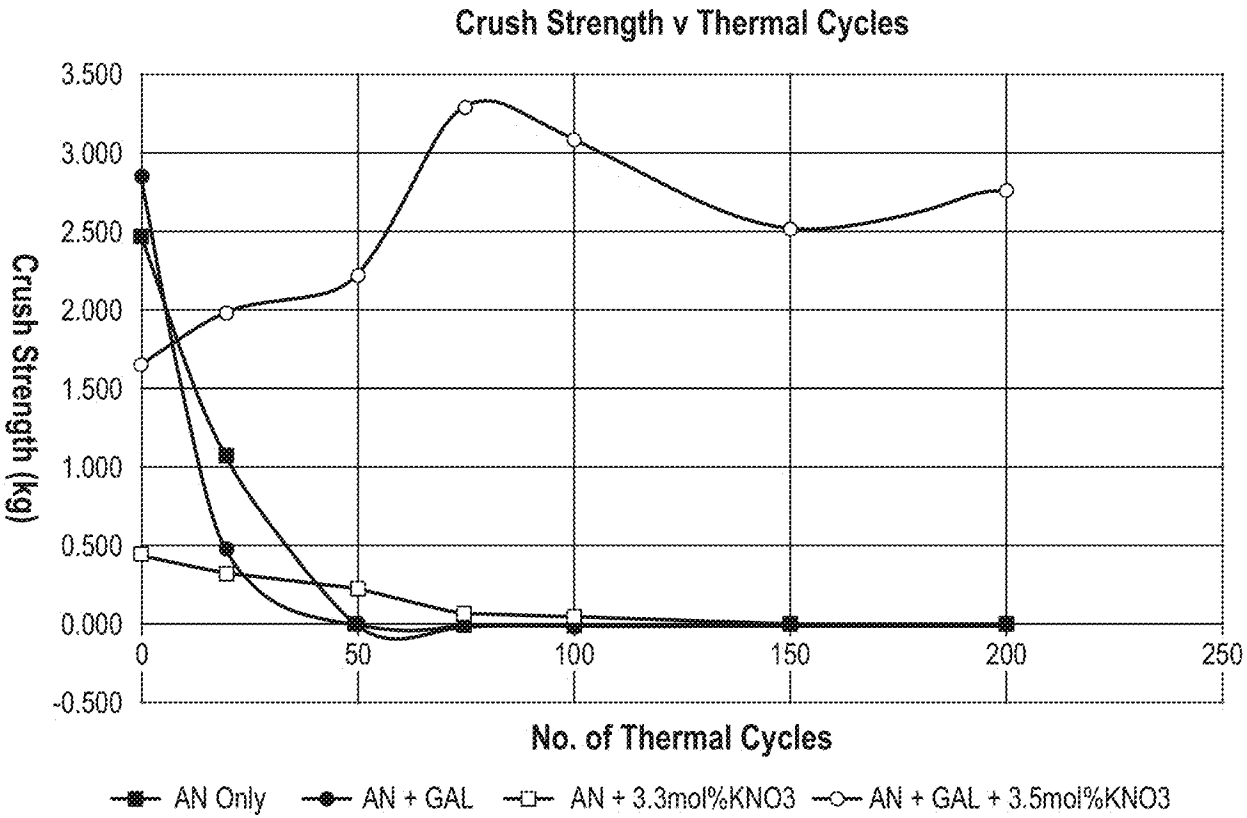
FIG. 13 is a graph of the results depicted in FIG. 12.

As indicated in FIG. 12 and FIG. 13, the AN only, and the AN and GALORYL® AT samples (AN+GALORYL® AT) decreased significantly in crush strength with ongoing thermal cycling to a point that they could no longer be tested for crush strength as the samples had turned into powder.

Figure 10:
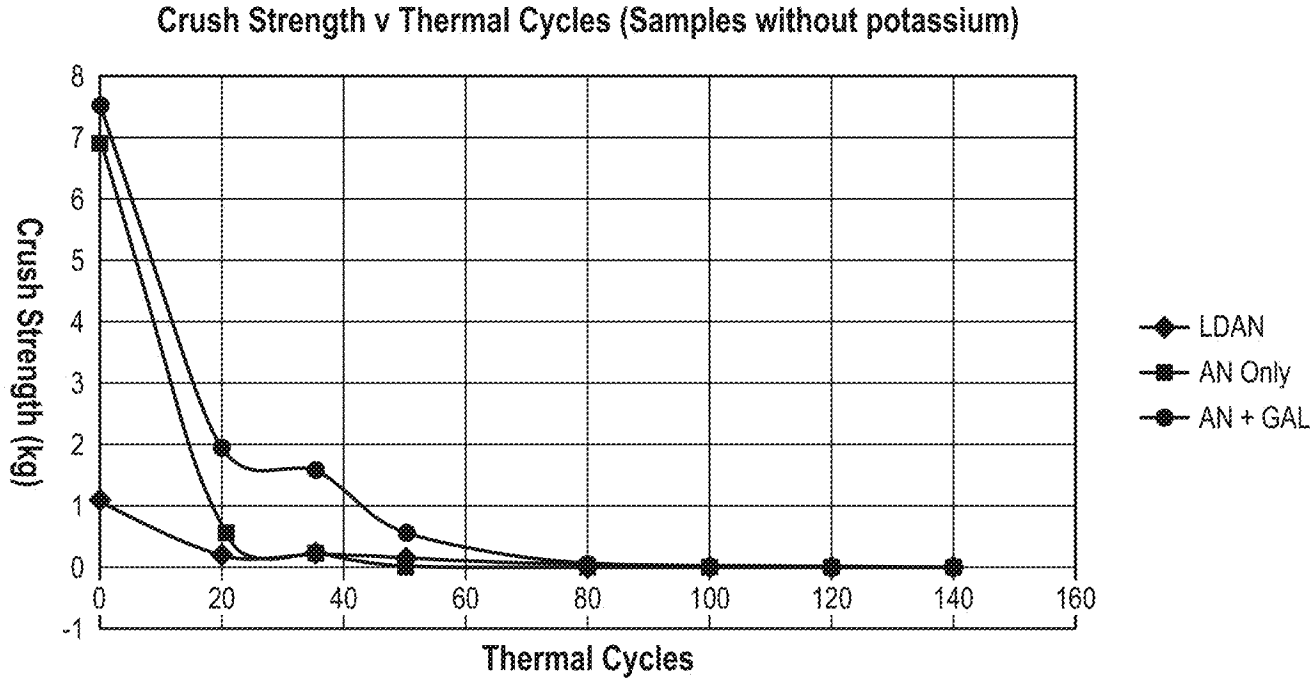
FIG. 10 is a graph showing the crush strength versus thermal cycles of various samples lacking potassium.
Figure 11:
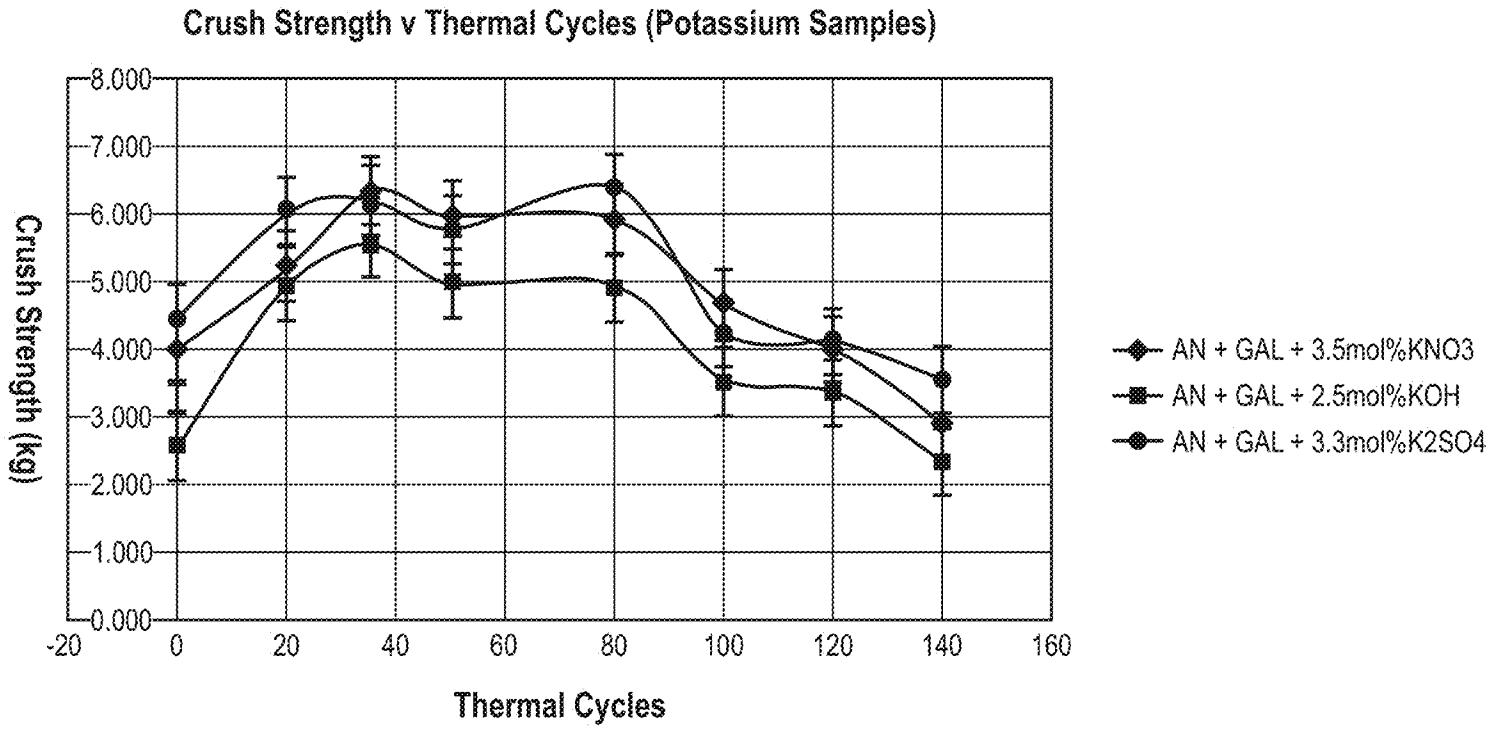
FIG. 11 is a graph showing the crush strength versus thermal cycles of various exemplary samples having potassium.

Unexpectedly, the samples including potassium salt and GALORYL® AT increased significantly in crush strength (hardness) after 20 thermal cycles and remained higher than the initial crush strength for a significant number of thermal cycles past that point (see FIGS. 10 and 11).

For example, with reference to FIG. 12, the AN formulations including potassium salts and GALORYL® AT have demonstrated that after 200 thermal cycles the product has not degraded (although the data is not shown, the product has also not degraded after 300 thermal cycles). This is a significantly enhanced outcome relative to the standard LDAN formulation, which shows signs of deterioration after 20 thermal cycles.

Example 6—Generation of Prill in a Plant for Analysis

The following samples were manufactured via a Kaltenbach Thuring process: 1) low density AN (LDAN) and 2) AN, approximately 700 ppm GALORYL® AT, 3.5 mol % of $KNO_3$, and GALORYL® ATH 626M (Exemplary PSAN prill, referred to as "Prill A"). GALORYL® ATH 626M includes an alkyl (C16-C18) naphthalene sulphonate sodium salt as the active material, which is blended with waxes and/or mineral oils and serves as an anti-caking agent coated onto Prill A. For the manufacture of Prill A in the plant, a solution of potassium nitrate ($KNO_3$), approximately 26.5 wt % concentration, was dosed continuously into the plant process, at a rate of approximately 2.5 tons per hour. The level of potassium nitrate solution dosed was equivalent to 3.5 mol % of potassium nitrate present in the final prill product. The dosing (tie-in) point for the potassium nitrate solution was into a process condensate line, which is located immediately prior to (and then flows directly to) the neutralizer. The solution of $KNO_3$ was dosed at ambient temperature into the plant process. GALORYL® AT (also referred to as "GAL") was added to the prilling process at approximately 700 ppm, and PSAN prill were formed in the prilling tower. Addition of coating (GALORYL® ATH 626M) was also added as per standard manufacturing parameters, and the product stored in shipping containers, with approximately 20 tons of Prill A per container. During this plant trial, approximately 200 tons of Prill A was manufactured in the plant. The prill production rate was ~20 tons per hour (3 prill heads out of 6 were on line) for approximately 10 hours. The production rate was maintained throughout the duration of the trial. Prill A prill samples were taken regularly and analyzed throughout the duration of the trial. Samples collected throughout the plant trial demonstrated that the Prill A prill product produced in the plant was within commercial specification. The plant was able to be operated in a stable manner throughout the duration of the Prill A trial. Throughout the plant trial, key prill parameters were monitored, and the data presented in Table 2 shows that the Prill A prill was manufactured within specification throughout the duration of the trial.

TABLE 2

Prill A testing results - plant trial

| Prill | Sample time | | | | | | | Customer |
|---|---|---|---|---|---|---|---|---|
| Parameter | 10:30 am | 12 pm | 2 pm | 3 pm | 4 pm | 5:30 pm | 7:20 pm | Spec |
| Moisture (%) | 0.06 | 0.06 | 0.09 | 0.06 | 0.06 | 0.06 | 0.07 | <0.2% |
| pH (10%) | 4.72 | 4.73 | 4.82 | 4.90 | 4.90 | 4.97 | 4.93 | 4.5-5.5 |
| Bulk Density (kg/L) | 0.74 | 0.72 | 0.70 | 0.70 | 0.71 | 0.70 | 0.71 | 0.70-0.78 |
| Fuel Oil Retention (%) | 9.4 | 9.2 | n/a | n/a | 8.9 | 8.6 | 8.0 | >6.0% |
| Fines (%) | 0.09 | 0.11 | 0.08 | 0.08 | 0.09 | 0.07 | 0.06 | <1.0% |
| Mean Particle Size (mm) | 1.75 | 1.72 | 1.74 | 1.74 | 1.71 | 1.73 | 1.68 | 1.6-2.4 |
| Friability (before cycling) (%) | 0.08 | 0.07 | n/a | n/a | 0.15 | 0.06 | 0.18 | <4% |
| Average Crush Strength (kg) | 1.1 | 0.6 | 0.5 | 0.6 | 0.6 | 0.8 | 0.6 | n/a |

Example 7—Prilled AN Fuel Absorption and Porosity Analysis

The following method was used to measure fuel oil retention (i.e., to determine the porosity of Prill A). The method measured the increase in mass of a selected sample of prill after total immersion in diesel fuel oil (DFO) and removal of excess DFO using paper towel. This method was a quality check used in product raw material evaluation. First, 40 g (+−0.05 g) sample of AN prill (fines removed)

were weighed into a labelled and tared 250 mL screw top sample jar. This was recorded as the 'Initial Weight'. Then 6.5 mL of DFO was added and distributed evenly over the sample. The lid was tightly screwed closed and shaken vigorously for 30 seconds. The sample jar was then placed on the bottle roller and the machine was operated for 20 minutes at 40 rpm. After 20 minutes, the jar was tapped on the bench to remove prill stuck to the lid. Two strips of blotting paper were placed: one wound loosely to fit along the sides of the jar; the second strip wound tightly and inserted into the center of the first strip of blotting paper. The lid was replaced then the jar was shaken by hand for 3 minutes. The prill was rolled freely in the jar. The sample jar was placed on the bottle roller and the machine was operated for 15 minutes at 40 rpm. Prill A spread out evenly along the length of the jar, and the roller was adjusted to achieve this. The absorbent paper strips were then carefully removed, ensuring no prill was removed from the jar. The prill was transferred to a tared 100 mL beaker and weighed to the nearest 0.05 g. This was recorded as the 'Final Weight'. The % Fuel Oil Retention (FOR) was calculated as follows:

$$\text{FOR (\%)}=((\text{Final Weight}-\text{Initial Weight})/\text{Final Weight})\times 100$$

Example 8—Thermal Analysis of Prills

Figure 15:
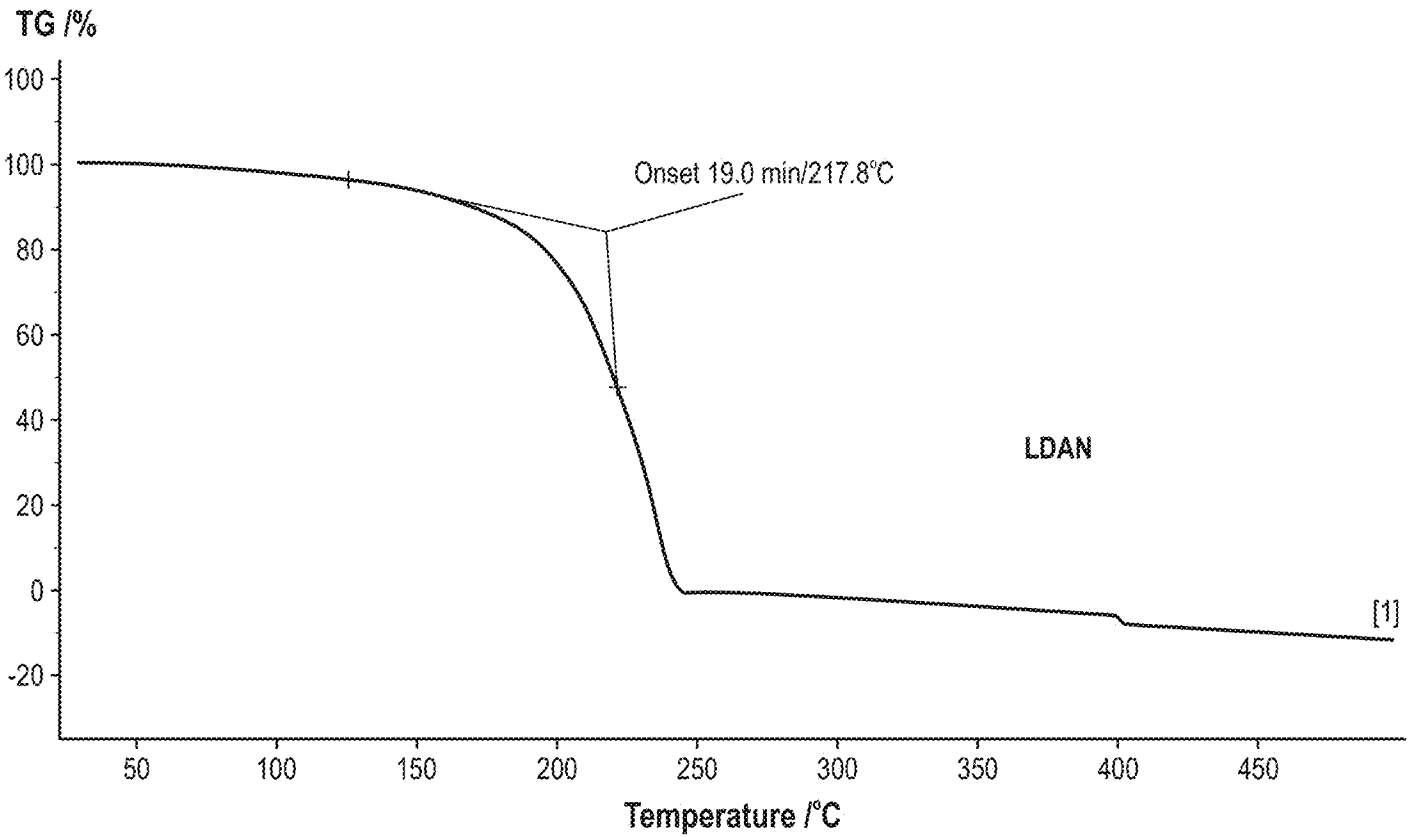
FIG. 15 is a graph showing TGA of an LDAN sample.
Figure 16:
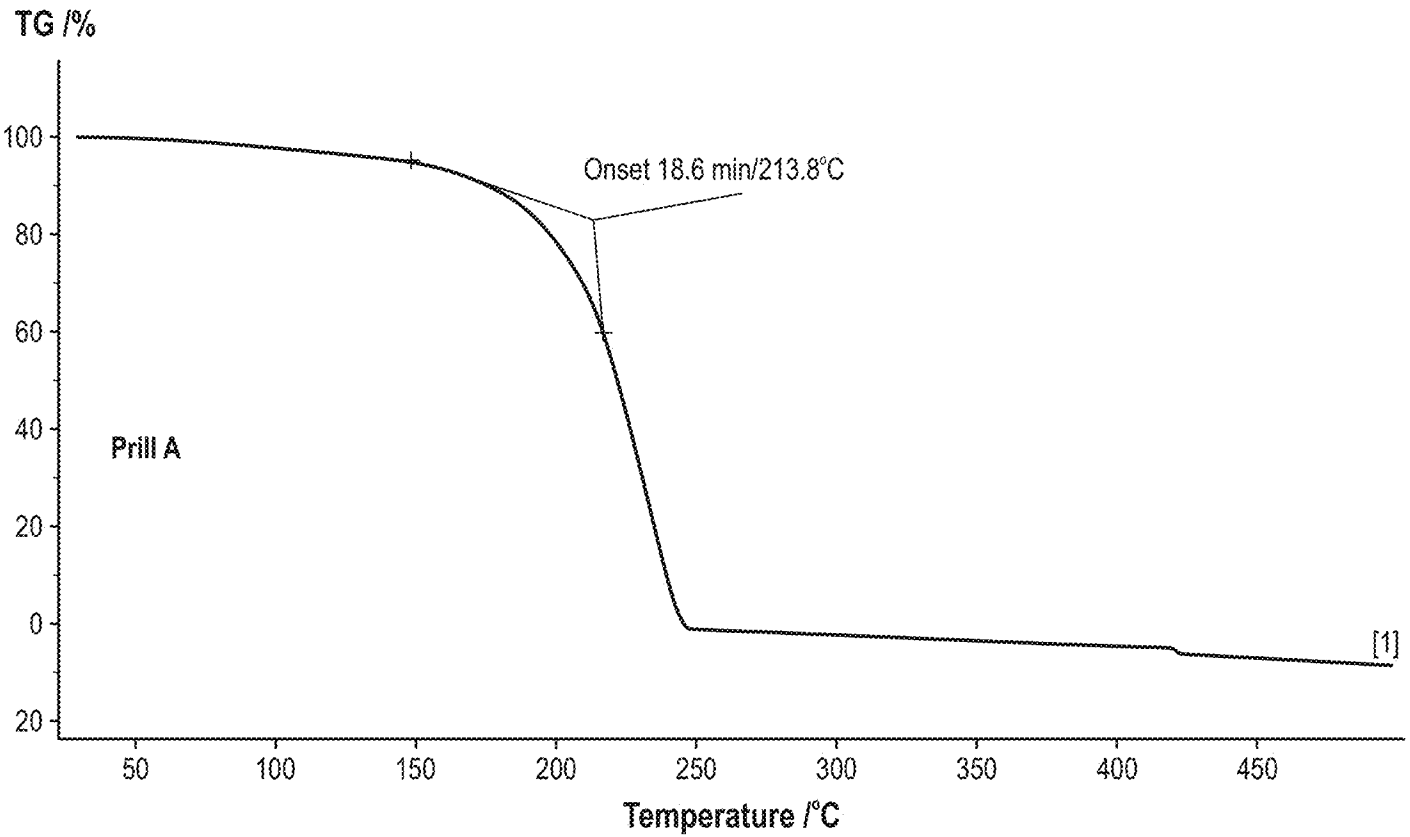
FIG. 16 is a graph showing TGA of a Prill A sample, according to an embodiment disclosed herein.
Figure 17:
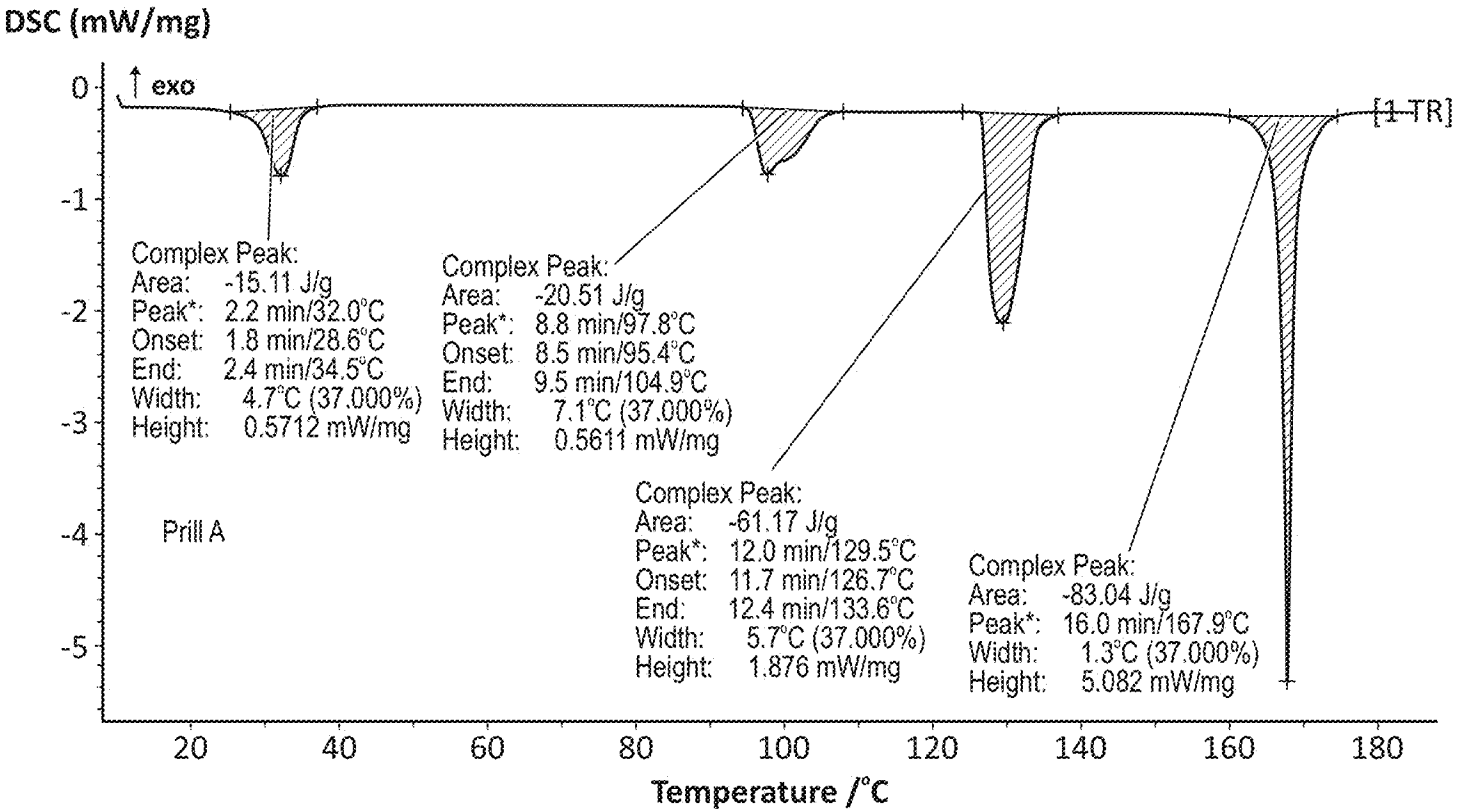
FIG. 17 is a graph showing DSC of a Prill A sample, according to an embodiment disclosed herein.
Figure 18:
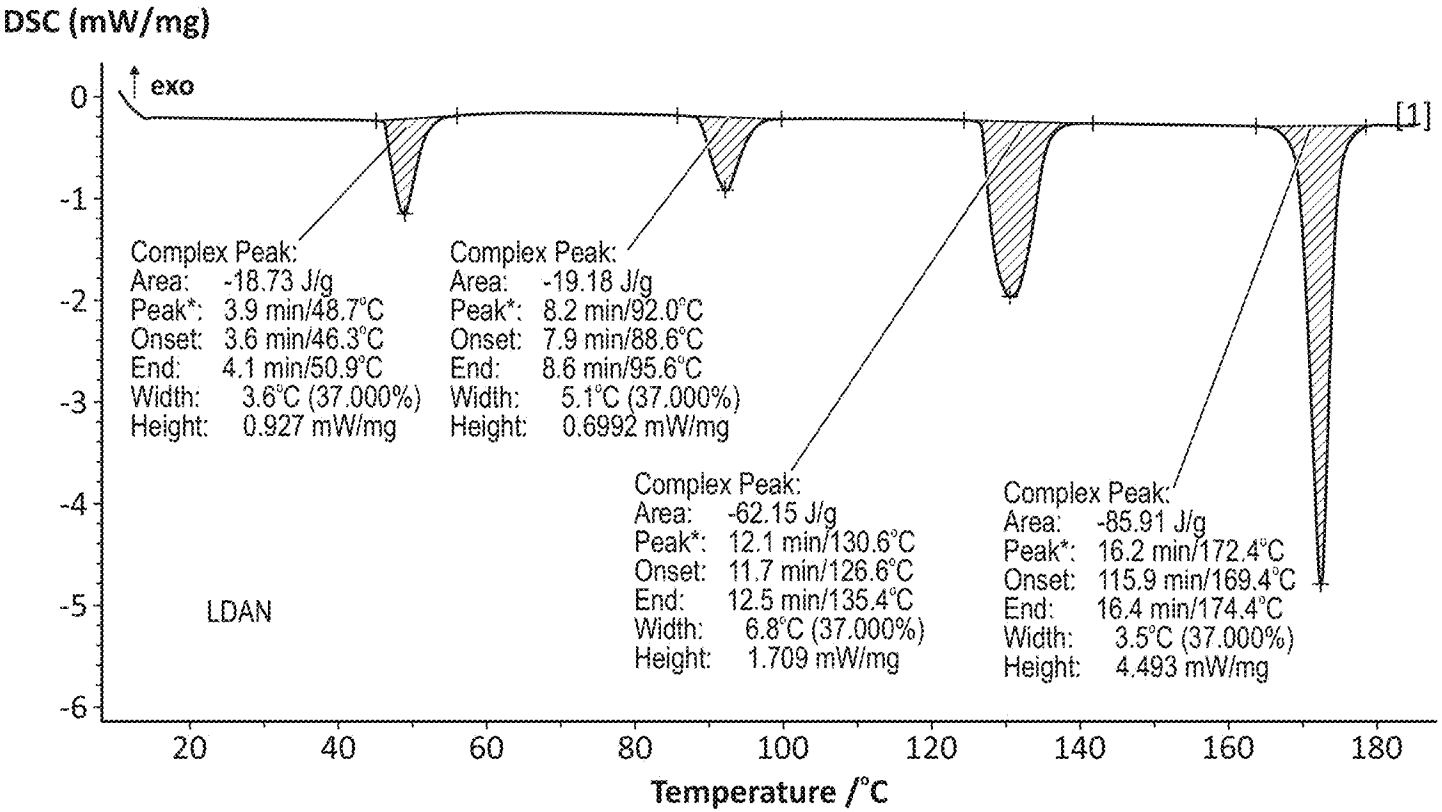
FIG. 18 is a graph showing DSC of a LDAN sample.

Prills of the various formulations generated above were then analyzed using a DSC (NETZSCH™ DSC 214 Polyma) and a TGA (NETZSCH™ TG 209 F3 TARSUS®). TGA analysis was performed on the various formulations. Thermal analysis performed on the LDAN and Prill A prill demonstrated that the onset of thermal decomposition was not significantly altered with the presence of potassium nitrate, compared to standard AN, as shown with the TGA data (FIG. 15, LDAN; and FIG. 16, Prill A). The DSC data showed that the 32° C. phase change was all but eliminated in the Prill A prill, with only a very small peak for the 32° C. phase change visible in the DSC data (see FIG. 17). Also, the 84° C. phase change has shifted higher to approximately 98° C. phase change in the Prill A DSC data (FIG. 17) when compared to LDAN DSC data (FIG. 18). Both of these phenomena are consistent with the data obtained using laboratory produced prilloids.

Example 9—Thermal Cycling and Crush Testing of Prills

The Prill A samples described in Example 6 were placed into a cycling oven (PANASONIC™ MIR-254 Cooled Incubator). The cycling oven was designed to mimic the thermal cycling that occurs in the field. The oven was set such that one cycle included a four-hour period at 15° C. followed by a four-hour period at 45° C. The samples were cycled a total of 300 times, although the data shown in Table 3 is through 200 cycles.

Throughout the cycling process, the condition and possible degradation of the samples was visually observed. Also, crush testing was performed at various points to demonstrate possible changes in hardness of the samples throughout the cycling process.

20 randomly selected sized (2.00 mm≤prill≤2.36 mm) AN prills were tested for crush resistance using a force gauge Model M5-5. The average crush resistance was then reported. All equipment including gloves was dry and the samples sealed in an air tight container when stored. Samples were prepared by first weighing 250 g of AN prill final product sample and transferring to the top of a sieve stack consisting of a 2.36 mm sieve, 2.00 mm sieve, and a collection pan. The samples and the sieve stack were placed in a sieve shaker for 10 mins with an amplitude setting of 60. The fines in the receiving pan and the oversized in the 2.36 mm sieve were discarded. A fraction of the sample from the 2.00 mm sieve was taken to be used for crush testing. For the crush test, 20 individual AN prills from the 2.00 mm sieve were randomly selected. A crush test apparatus comprising a force gauge meter (model M5-5) and a test stand stage (motorized test stand ESM301L) was used to record KgF units. A prill was placed in the center of the test stand stage. Zero was selected on the force gauge meter, then the down arrow button on the test stage controller. The force gauge piston was lowered to crush the test prill. After the force gauge had fully extended, the applied force was recorded as the crush resistance. This process was performed for a total of 20 prills. Crush resistance was calculated as the average crush resistance of the 20 prills.

Samples were tested for crush strength (hardness) throughout the process of thermal cycling. Crush testing was performed at the points indicated in Table 3.

TABLE 3

Crush testing data - standard LDAN vs Prill A

| Sample | Average Crush Strength (kg) Initial (0 cycles) | Average Crush Strength (kg) 20 cycles | % Change from Initial Average Crush Strength (20 cycles) | Average Crush Strength (kg) 40 cycles | % Change from Initial Average Crush Strength (40 cycles) | Average Crush Strength (kg) 50 cycles | % Change from Initial Average Crush Strength (50 cycles) |
|---|---|---|---|---|---|---|---|
| Std LDAN Prill | 0.98 | 0.174 | −82.2 | 0.05 | −94.9 | Unable to Crush - sample is dust | |
| Prill A Prill | 0.68 | 0.87 | 27.9 | 0.94 | 38.2 | 0.783 | 15.1 |

| Sample | Average Crush Strength (kg) Initial (0 cycles) | Average Crush Strength (kg) 60 cycles | % Change from Initial Average Crush Strength (60 c', des) | Average Crush Strength (kg) 80 cycles | % Change from Initial Average Crush Strength (80 cycles) | Average Crush Strength (kg) 100 cycles | % Change from initial Average Crush Strength (100 cycles) |
|---|---|---|---|---|---|---|---|
| Std LDAN Prill (ex MBH) | 0.98 | Unable to Crush - sample is dust | | Unable to Crush - sample is dust | | Unable to Crush - sample is dust | |
| Prill A Prill | 0.68 | 0.826 | 21.5 | 0.722 | 6.2 | 0.814 | 19.7 |

TABLE 3-continued

Crush testing data - standard LDAN vs Prill A

| Sample | Average Crush Strength (kg) Initial (0 cycles) | Average Crush Strength (kg) 120 cycles | % Change from Initial Average Crush Strength (120 cycles) | Average Crush Strength (kg) 140 cycles | % Change from Initial Average Crush Strength (140 cycles) | Average Crush Strength (kg) 150 cycles | % Change from Initial Average Crush Strength (150 cycles) |
|---|---|---|---|---|---|---|---|
| Std LDAN Prill | 0.98 | Unable to Crush - sample is dust | | Unable to Crush - sample is dust | | Unable to Crush - sample is dust | |
| Prill A Prill | 0.68 | 0.810 | 19.1 | 0.854 | 25.6 | 0.892 | 31.2 |

| Sample | Average Crush Strength (kg) Initial (0 cycles) | Average Crush Strength (kg) 160 cycles | % Change from initial Average Crush Strength (160 cycles) | Average Crush Strength (kg) 180 cycles | % Change from Initial Average Crush Strength (180 cycles) | Average Crush Strength (kg) 200 cycles | % Change from Initial Average Crush Strength (200 cycles) |
|---|---|---|---|---|---|---|---|
| Std LOAN Prill | 0.98 | Unable to Crush - sample is dust | | Unable to Crush - sample is dust | | Unable to Crush - sample is dust | |
| Prill A Prill | 0.68 | 0.853 | 25.4 | 0.886 | 30.3 | 0.832 | 22.4 |

Figure 19:
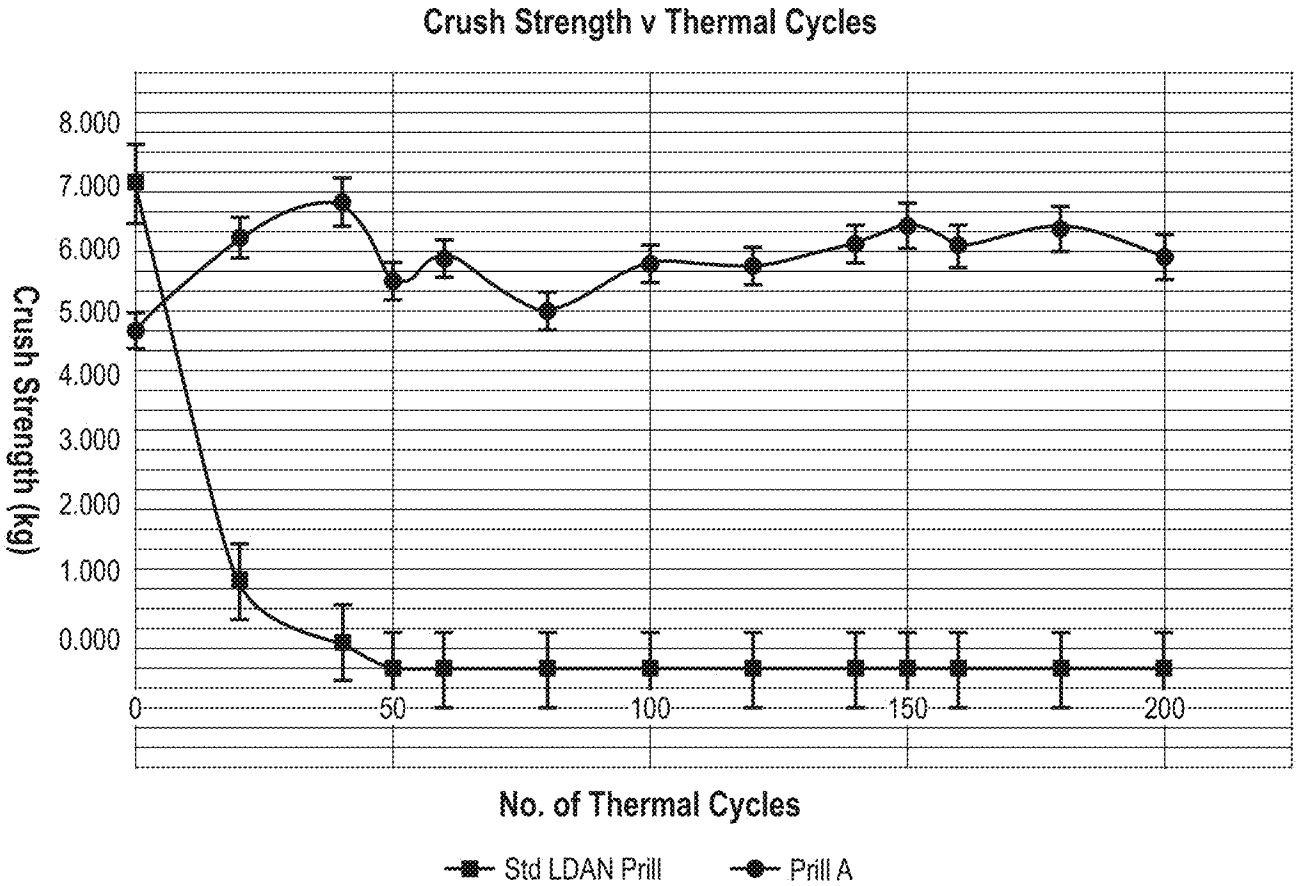
FIG. 19 is a graph showing the crush strength versus thermal cycles of LDAN prill and Prill A, according to an embodiment disclosed herein.
Figure 21A:
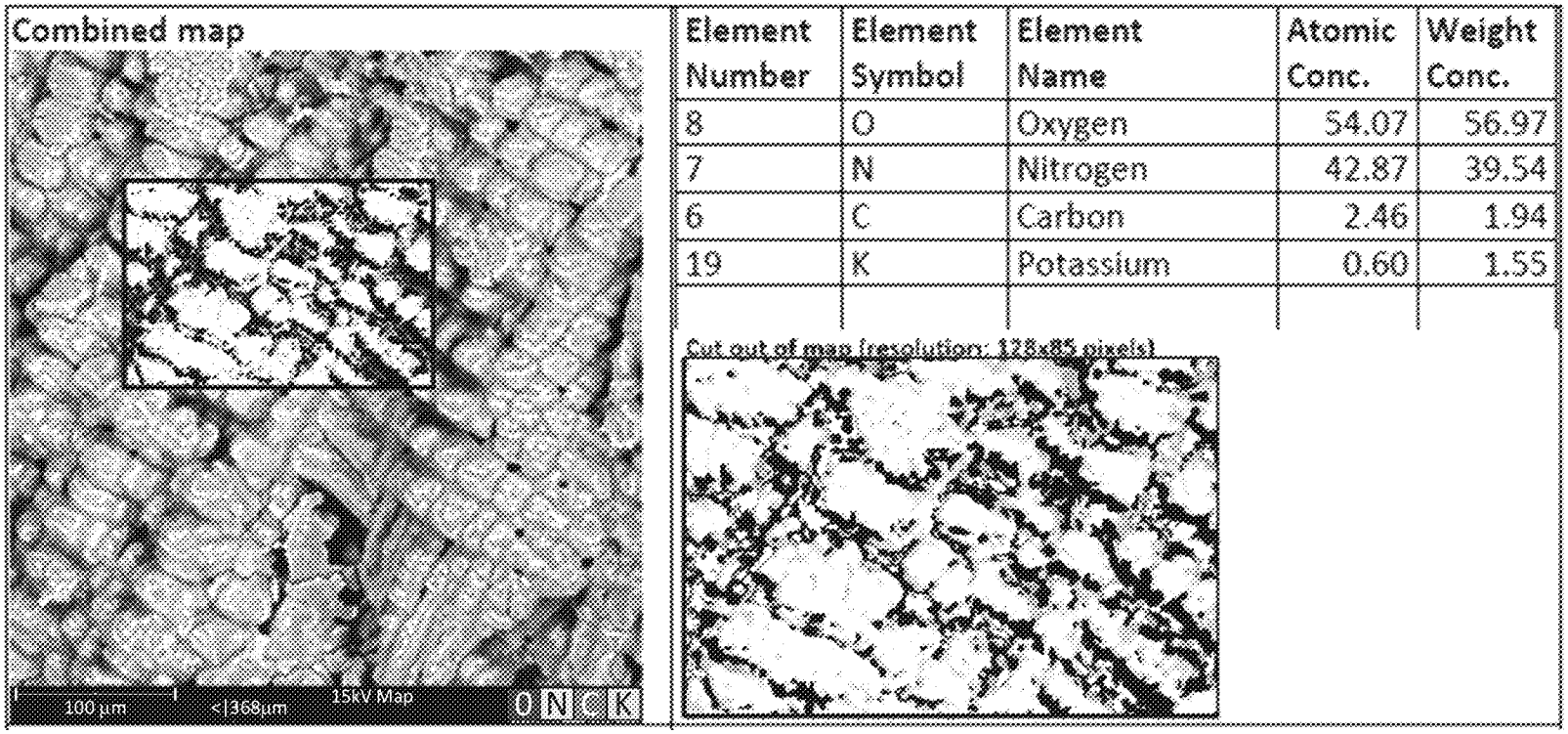
FIG. 21A depicts the morphology and elemental mapping of the inside of a Prill A prill, according to an embodiment disclosed herein, analyzed by Scanning Electron Microscope with Energy Dispersive Spectroscopy (SEM-EDS). The left panel depicts the combined morphology and element mapping images. The upper right panel shows oxygen, nitrogen, carbon, and potassium elements detected by the element mapping analysis. The lower right panel depicts the morphology of the inside of the Prill A prill.
Figure 21B:
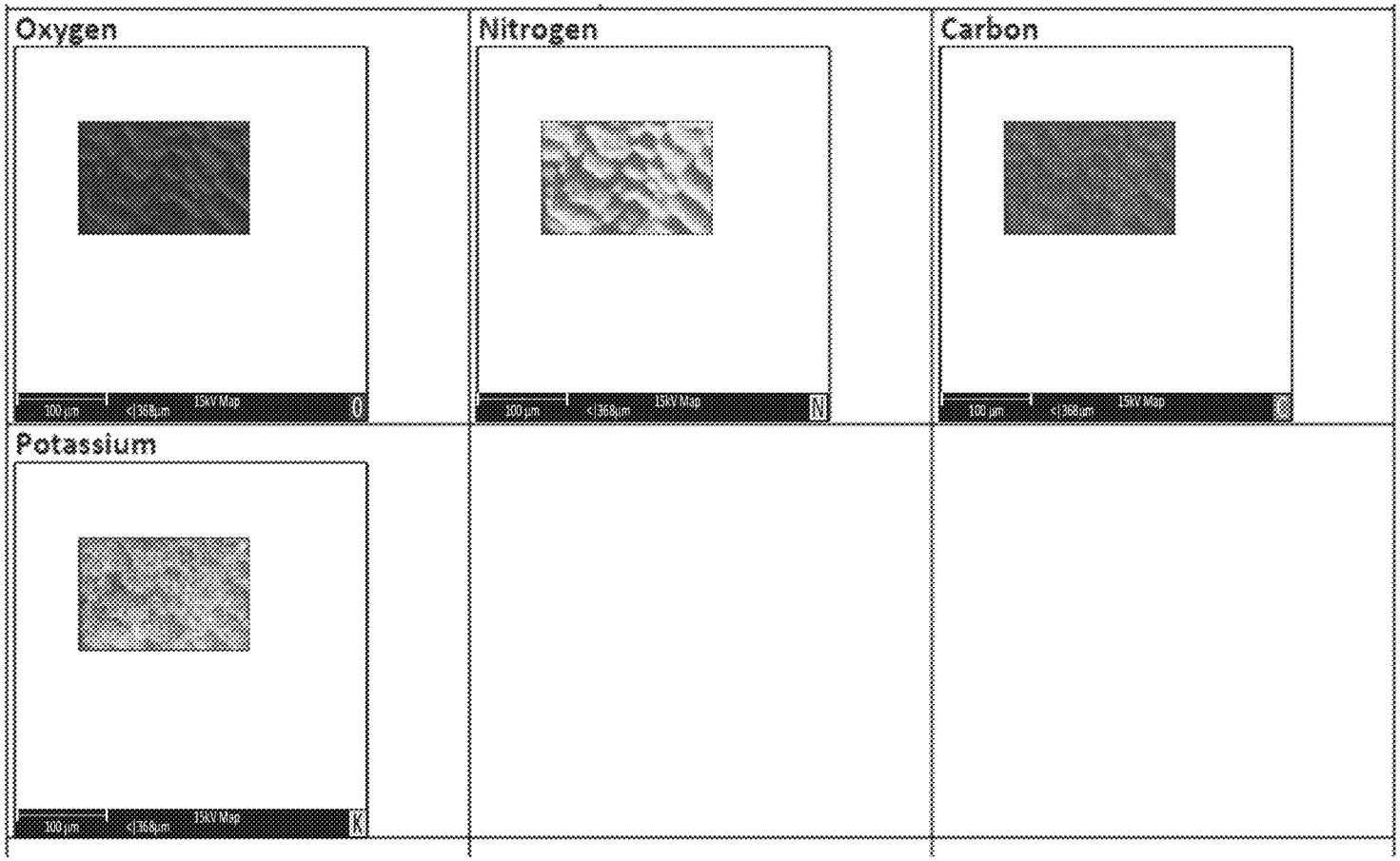
FIG. 21B upper panels from left to right, depict the elemental mapping of oxygen, nitrogen, and carbon on the inside of a Prill A prill, according to an embodiment disclosed herein. The lower panel depicts the elemental mapping of potassium on the inside of a Prill A prill, according to an embodiment disclosed herein.
Figure 23A:
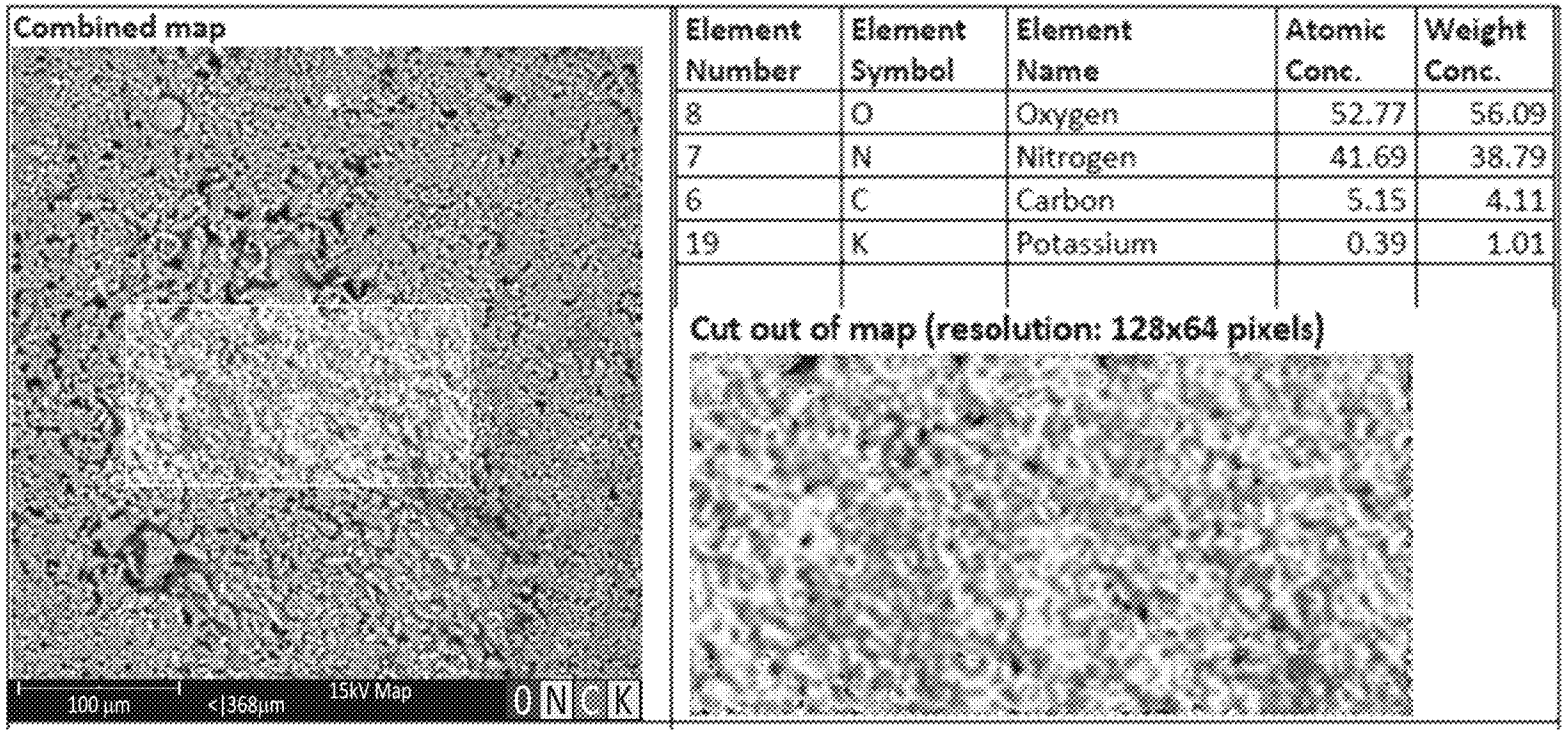
FIG. 23A depicts the morphology and elemental mapping of the outside of a Prill A prill, according to an embodiment disclosed herein, analyzed by Scanning Electron Microscope with Energy Dispersive Spectroscopy (SEM-EDS). The left panel depicts the combined morphology and element mapping images. The upper right panel shows oxygen, nitrogen, carbon, and potassium elements detected by the element mapping analysis. The lower right panel depicts the morphology of the outside of the Prill A prill.
Figure 23B:
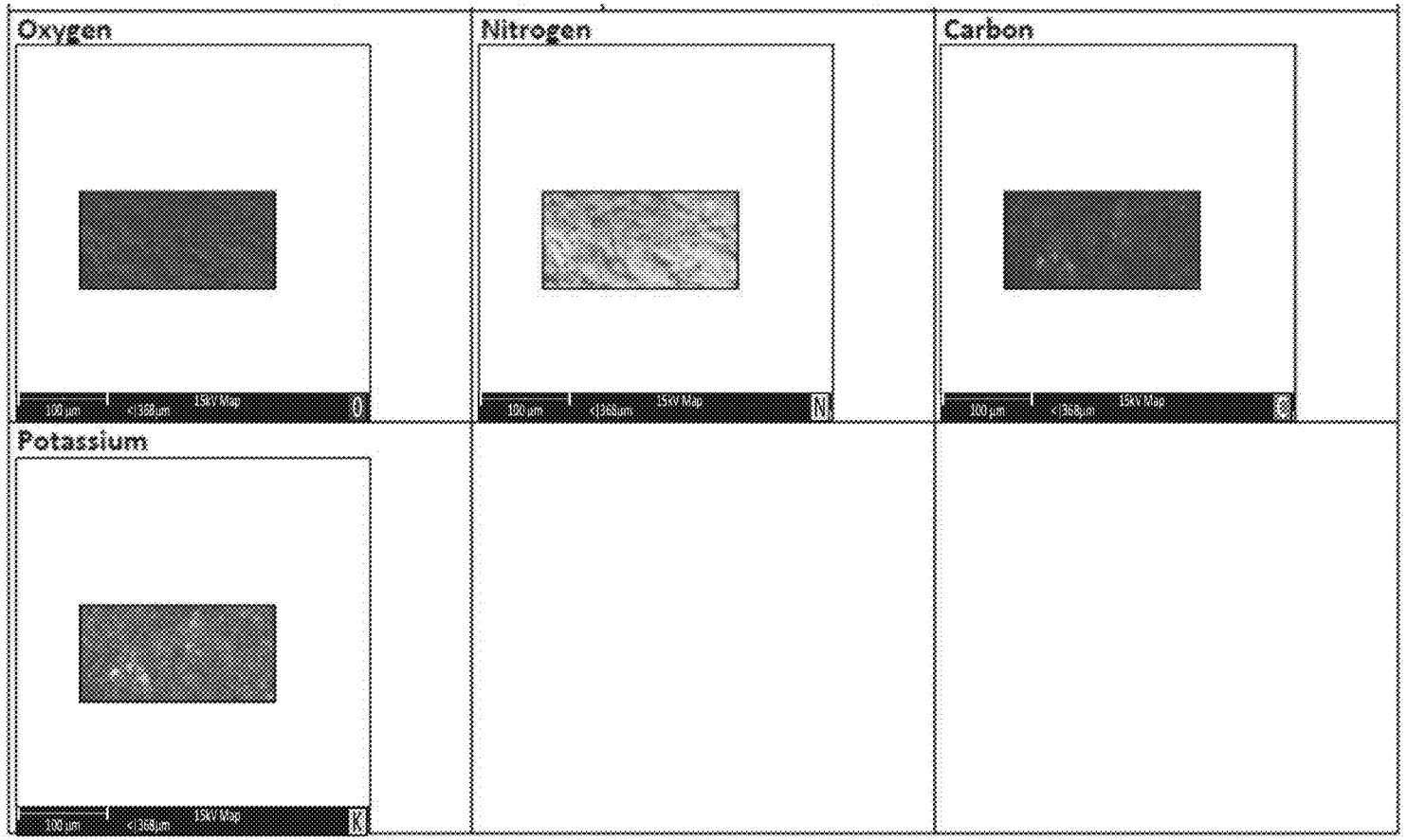
FIG. 23B upper panels from left to right, depict the elemental mapping of oxygen, nitrogen, and carbon on the outside of a Prill A prill, according to an embodiment disclosed herein. The lower panel depicts the elemental mapping of potassium on the outside of a Prill A prill, according to an embodiment disclosed herein.

The crush testing data shown in Table 3 and FIG. 19 demonstrate that the standard LDAN product was significantly degraded after 20 thermal cycles, and continued to degrade with thermal cycling until it was unable to be crushed. The Prill A prill increased in crush strength with thermal cycling initially and maintained a higher than initial crush strength for at least 200 thermal cycles. This is consistent with the data obtained with prilloid samples including potassium salt and GALORYL® AT shown in FIGS. 12 and 13.

Example 10—Morphology and Elemental Mapping of Prill

Samples of Prill A and a sample of standard LDAN were analyzed in the Scanning Electron Microscope with Energy Dispersive Spectroscopy (SEM-EDS). The purpose of this was to compare the morphology/microstructure of the phase stabilized AN prill (FIGS. 21A, 21B, 23A and 23B) and the standard LDAN prill (FIGS. 20A, 20B, 22A and 22B). Also, elemental mapping was performed to determine (in particular) the distribution of the potassium ion throughout the phase stabilized AN. Prills of each sample were cut in half with a prill cutter, to scan the inside of the prill (FIGS. 20A, 20B, 21A and 21B). Whole prills were also scanned on the outside of the prill (see FIGS. 22A, 22B, 23A and 23B). The morphology of the Prill A and standard LDAN, one the inner half of the prill, showed that the Prill A have more uniform/more tightly packed crystal domains, when compared to the standard LDAN prill. The elemental mapping showed that the potassium is uniformly distributed both on the inner half and outside of the prill. This effect was also seen with the laboratory produced prilloids.

Example 11—Generation of Emulsions for Analysis

With the introduction of a potassium salt into the AN solution (ANSol) stream in the AN plant, emulsion products may also be made utilizing potassium in the oxidizer solution of the discontinuous phase. The use of potassium nitrate at the expected percentage level in all emulsion products was validated for compatibility. Also, given the differences in formulation when remelting AN prill into emulsion, versus manufacturing with ANSol only, three conventional formulations, each as virgin ANSol and 100% remelt were manufactured and fully characterized—with the inclusion of potassium in the oxidizer phase (from 3.3 to 3.5 mass %, depending on the emulsion). The conventional emulsions (containing potassium) were manufactured in 1 kg batches. These emulsion batches were then used to perform a comparison with the conventional emulsion formulations without potassium in the oxidizer. In each case, the emulsions containing potassium in the oxidizer met specifications standards for that emulsion. Each emulsion formulation was refined for varying amounts of time at 1700 rpm to reach target viscosity. A Lightnin' overhead mixer and Jiffy mixer blade were used. Viscosity measurement used a Brookfield RV, spindle #7, 20 rpm. The results obtained from the analysis performed for the ANSol and remelt formulations with potassium nitrate present in the oxidizer were not significantly different to conventional emulsion formulations without potassium in the oxidizer, regarding time taken to refine to target viscosity.

Shear ramp and hold tests were performed on each emulsion formulation. The results obtained from the analysis performed for the ANSol and remelt formulations with potassium nitrate present in the oxidizer were not significantly different from the conventional emulsion formulations without potassium in the oxidizer, regarding rheology.

Samples of each emulsion were stored at room temperature (~25° C.) and at 40° C. The samples were monitored for stability and viscosity over 28 days. The results obtained from the analysis performed for the ANSol and remelt formulations with potassium nitrate present were not significantly different from conventional emulsion formulations without potassium present in the oxidizer, regarding emulsion stability.

Emulsion blends (both with and without potassium nitrate in the emulsion) were gassed at room temperature with a chemical gassing agent. The results obtained from the analysis performed for the ANSol and remelt formulations with potassium nitrate present in the oxidizer were not significantly different to conventional emulsion formulations without potassium present in the oxidizer, regarding gassing profile.

The stability of the gassed blends of the ANSol and remelt formulations were tested over a period of 28 days. The static water resistance (swell and penetration) of each of the gassed blends of the ANSol and remelt formulations were tested over 28 days. The results obtained from the analysis performed for the ANSol and remelt formulations with potassium nitrate present in the oxidizer were not significantly different to conventional emulsion formulations without potassium in the oxidizer, regarding gassed blend stability.

Example 12—Analysis of Detonation Velocity

Samples of standard LDAN and Prill A were test blasted. Both the LDAN and Prill A were used to prepare ANFO, at a ratio of 94:6. Preparation of ANFO was to manually mix the prill with diesel fuel oil under absorbed and homogeneous, and then loose poured into PVC pipes. These were prepared in duplicate for ANFO using LDAN and ANFO using Prill A. Each of these pipes were 75 mm in internal diameter, and approximately 0.5 m in length. The charge weight for each pipe was approximately 2 kg. A #12 strength MS electric detonator and a 400 g Trojan NBU pentolite booster were used to initiate each of the pipes. Velocity of Detonation (VoD) was measured for each of the charges. A Handitrap II™ VoD recorder was used, fitted with 300Ω probes, to measure velocity of detonation. VoD results are seen in Table 20. All pipes detonated were fully consumed during each blast, indicating complete detonation of all products. Test blasting of the Prill A prill (as ANFO) demonstrated that the Prill A and the standard LDAN were successfully detonated under the same conditions, with acceptable VoD's observed for both products.

TABLE 4

Velocity of Detonation results

| Product | Velocity of Detonation (m/s) | Uncertainty (m/s) |
|---|---|---|
| Standard LDAN ANFO | 3100 | +30 |
| PSAN ANFO | 2900 | +26 |

Example 13—Reactive Ground Testing

Reactive ground testing using the plant manufactured Prill A prill for ANFO in an inhibited emulsion blend containing potassium nitrate in the oxidizer was performed, to ensure there was no significant difference in inhibition when potassium was present in the prill as well as in the emulsion. Standard emulsion/ANFO blends were used as controls with the same reactive ground samples. Samples were tested at 70° C. for 28 days, as per Appendix 3 of the AEISG Code of Practice: Elevated Temperature and Reactive Ground. No exotherms were observed, apart for the internal AN control. The reactive ground results demonstrated that the presence of potassium in both the emulsion matrix and the Prill A prill did not affect the inhibition properties of the inhibited emulsion blends when tested with known reactive samples. There was no significant difference observed between reactive ground testing performed using inhibited emulsion (with potassium in the emulsion matrix and Prill A prill), compared with standard inhibited emulsion blends with LDAN prill.

Example 14—Series 8 UN Testing

The UN Series 2(a) Gap Test was performed on the Prill A prill, as per the United Nations: Manual of Tests and Criteria. The test was performed in duplicate and on both occasions the tube remained intact, and the witness plate was not punctured. Therefore, Prill A was determined as not sensitive, under confinement in a steel tube, to detonative shock. UN testing of the Prill A prill demonstrated that the Prill A prill produced in the plant met the criteria for the UN Series 2(a) Gap Test.

Three conventional emulsion formulations were manufactured in the laboratory, with potassium nitrate present in the oxidizer (from 3.3 to 3.5 mass %, depending on the emulsion). Series 8 UN testing performed on the emulsions. Series 8(a), 8(b), 8(c) and 8(d)(ii) UN testing was performed. The results of the testing demonstrated that each of the three products were insensitive enough for inclusion in Division 5.1 and for transport in tanks. These three emulsion products can be classified as UN3375 DG Class 5.1 Oxidizing Agent.

Example 15—Analysis of Various Potassium Levels

To determine if the level of potassium could be reduced, but still achieve a significantly improved shelf life compared to standard LDAN, several iterations of prilloid batches were manufactured using the method of Example 1. Each of these batches were subjected to thermal cycling and crush strength testing performed over time.

The following prilloids were prepared:

1) AN+700 ppm GAL+3.0 mol % KNO3
2) AN+700 ppm GAL+2.5 mol % KNO3
3) AN+700 ppm GAL+2.0 mol % KNO3
4) AN+700 ppm GAL+1.5 mol % KNO3
5) AN+700 ppm GAL+1.0 mol % KNO3
6) AN+700 ppm GAL+0.5 mol % KNO3

Figure 24:
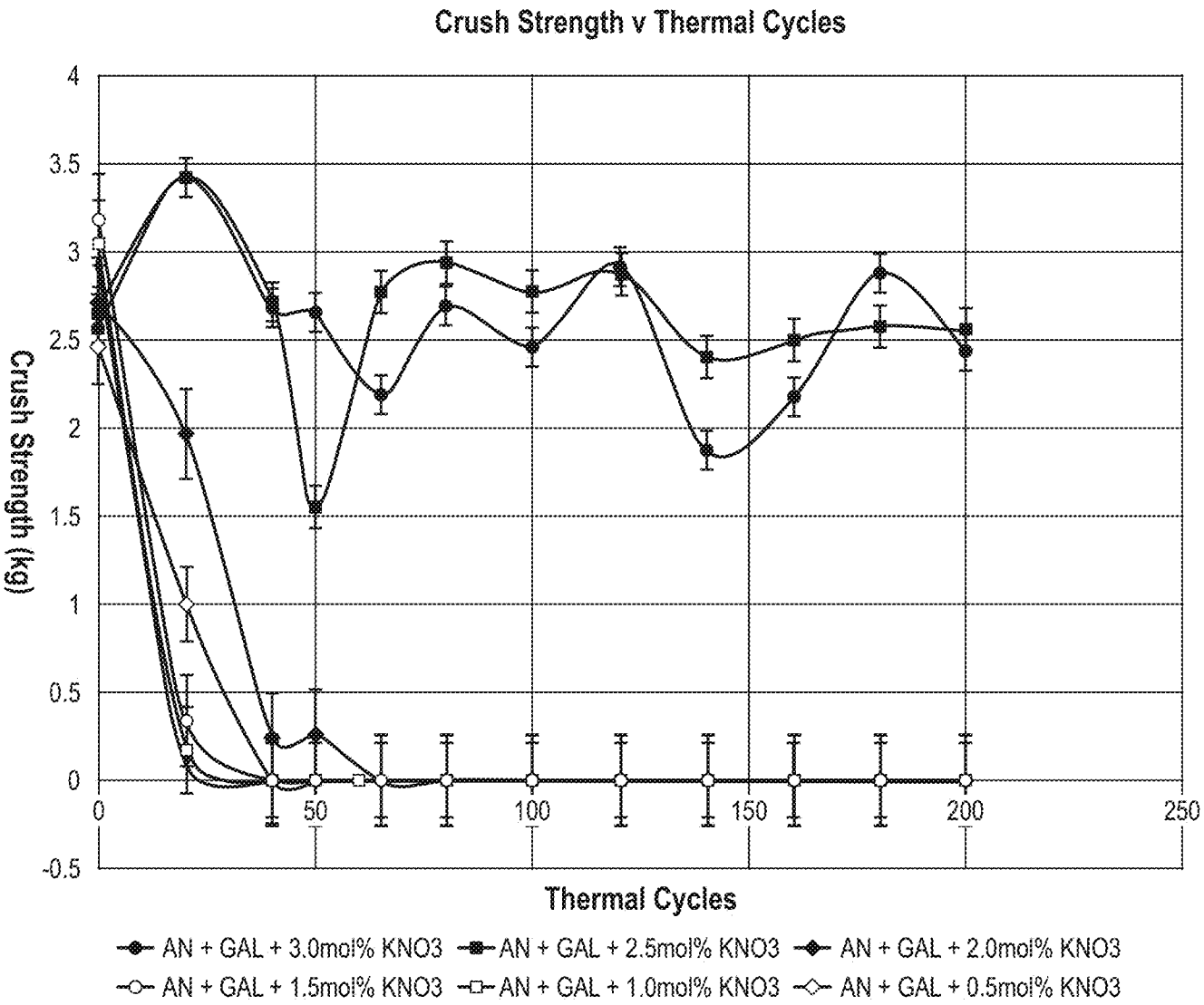
FIG. 24 depicts exemplary crush strength versus thermal cycling for exemplary prilloids with various potassium concentrations.

These prilloid batches were cycled for a total of 200 thermal cycles, and the results are shown in Table 5 and FIG. 24.

TABLE 5

| Sample | Average Crush Strength (kg) Initial (0 cycles) | Average Crush Strength (kg) 20 cycles | % Change from Initial Average Crush Strength (20 cycles) | Average Crush Strength (kg) 40 cycles | % Change from Initial Average Crush Strength (40 cycles) | Average Crush Strength (kg) 50 cycles | % Change from Initial Average Crush Strength (50 cycles) |
|---|---|---|---|---|---|---|---|
| AN + GAL + 3.0 mol % KNO3 | 2.58 | 3.42 | 32.6 | 2.68 | 3.9 | 2.650 | 2.7 |
| AN + GAL + 2.5 mol % KNO3 | 2.67 | 3.42 | 28.1 | 2.71 | 1.5 | 1.550 | −41.9 |
| AN + GAL + 2.0 mol % KNO3 | 2.71 | 1.97 | −27.3 | 0.24 | −91.1 | 0.26 | −90.4 |

TABLE 5-continued

| | | | | | |
|---|---|---|---|---|---|
| AN + GAL + 1.5 mol % KNO3 | 3.18 | 0.335 | −89.5 | Unable to Crush - Sample is powder | Unable to Crush - Sample is powder |
| AN + GAL + 1.0 mol % KNO3 | 3.04 | 0.181 | −94.0 | Unable to Crush - Sample is powder | Unable to Crush - Sample is powder |
| AN + GAL + 0.5 mol % KNO3 | 2.46 | 1.000 | −59.3 | Unable to Crush - Sample is powder | Unable to Crush - Sample is powder |

| Sample | Average Crush Strength (kg) Initial (0 cycles) | Average Crush Strength (kg) 65 cycles | % Change from initial Average Crush Strength (65 cycles) | Average Crush Strength (kg) 80 cycles | % Change from initial Average Crush Strength (80 cycles) | Average Crush Strength (kg) 100 cycles | % Change from initial Average Crush Strength (100 cycles) |
|---|---|---|---|---|---|---|---|
| AN + GAL + 3.0 mol % KNO3 | 2.58 | 2.19 | −15.1 | 2.690 | 4.3 | 2.470 | −4.3 |
| AN + GAL + 2.5 mol % KNO3 | 2.67 | 2.76 | 3.4 | 2.94 | 10.1 | 2.770 | 3.7 |
| AN + GAL + 2.0 mol % KNO3 | 2.71 | Unable to Crush - Sample is powder | | Unable to Crush - Sample is powder | | Unable to Crush - Sample is powder | |
| AN + GAL + 1.5 mol % KNO3 | 3.18 | Unable to Crush - Sample is powder | | Unable to Crush - Sample is powder | | Unable to Crush - Sample is powder | |
| AN + GAL + 1.0 mol % KNO3 | 3.04 | Unable to Crush - Sample is powder | | Unable to Crush - Sample is powder | | Unable to Crush - Sample is powder | |
| AN + GAL + 0.5 mol % KNO3 | 2.46 | Unable to Crush - Sample is powder | | Unable to Crush - Sample is powder | | Unable to Crush - Sample is powder | |

| Sample | Average Crush Strength (kg) Initial (0 cycles) | Average Crush Strength (kg) 120 cycles | % Change from Initial Average Crush Strength (120 cycles) | Average Crush Strength (kg) 140 cycles | % Change from Initial Average Crush Strength (140 cycles) | Average Crush Strength (kg) 160 cycles | % Change from Initial Average Crush Strength (160 cycles) |
|---|---|---|---|---|---|---|---|
| AN + GAL + 3.0 mol % KNO3 | 2.58 | 2.92 | 13.2 | 1.874 | −27.4 | 2.176 | −15.7 |
| AN + GAL + 2.5 mol % KNO3 | 2.67 | 2.878 | 7.8 | 2.404 | −10 | 2.496 | −6.5 |
| AN + GAL + 2.0 mol % KNO3 | 2.71 | Unable to Crush - Sample is powder | | Unable to Crush - Sample is powder | | Unable to Crush - Sample is powder | |
| AN + GAL + 1.5 mol % KNO3 | 3.18 | Unable to Crush - Sample is powder | | Unable to Crush - Sample is powder | | Unable to Crush - Sample is powder | |
| AN + GAL + 1.0 mol % KNO3 | 3.04 | Unable to Crush - Sample is powder | | Unable to Crush - Sample is powder | | Unable to Crush - Sample is powder | |
| AN + GAL + 0.5 mol % KNO3 | 2.46 | Unable to Crush - Sample is powder | | Unable to Crush - Sample is powder | | Unable to Crush - Sample is powder | |

| Sample | Average Crush Strength (kg) initial (0 cycles) | Average Crush Strength (kg) 180 cycles | % Change from initial Average Crush Strength (180 cycles) | Average Crush Strength (kg) 200 cycles | % Change from initial Average Crush Strength (200 cycles) |
|---|---|---|---|---|---|
| AN + GAL + 3.0 mol % KNO3 | 2.58 | 2.876 | 11.5 | 2.442 | −5.3 |
| AN + GAL + 2.5 mol % KNO3 | 2.67 | 2.581 | −3.3 | 2.553 | −4.4 |
| AN + GAL + 2.0 mol % KNO3 | 2.71 | Unable to Crush - Sample is powder | | Unable to Crush - Sample is powder | |
| AN + GAL + 1.5 mol % KNO3 | 3.18 | Unable to Crush - Sample is powder | | Unable to Crush - Sample is powder | |
| AN + GAL + 1.0 mol % KNO3 | 3.04 | Unable to Crush - Sample is powder | | Unable to Crush - Sample is powder | |
| AN + GAL + 0.5 mol % KNO3 | 2.46 | Unable to Crush - Sample is powder | | Unable to Crush - Sample is powder | |

Another set of prilloid batches were produced using the method of Example 1. These batches were also subjected to thermal cycling and crush strength analysis. These batches included:

1) AN+700 ppm GAL+2.4 mol % KNO3
2) AN+700 ppm GAL+2.3 mol % KNO3
3) AN+700 ppm GAL+2.2 mol % KNO3
4) AN+700 ppm GAL+2.1 mol % KNO3

Figure 25:
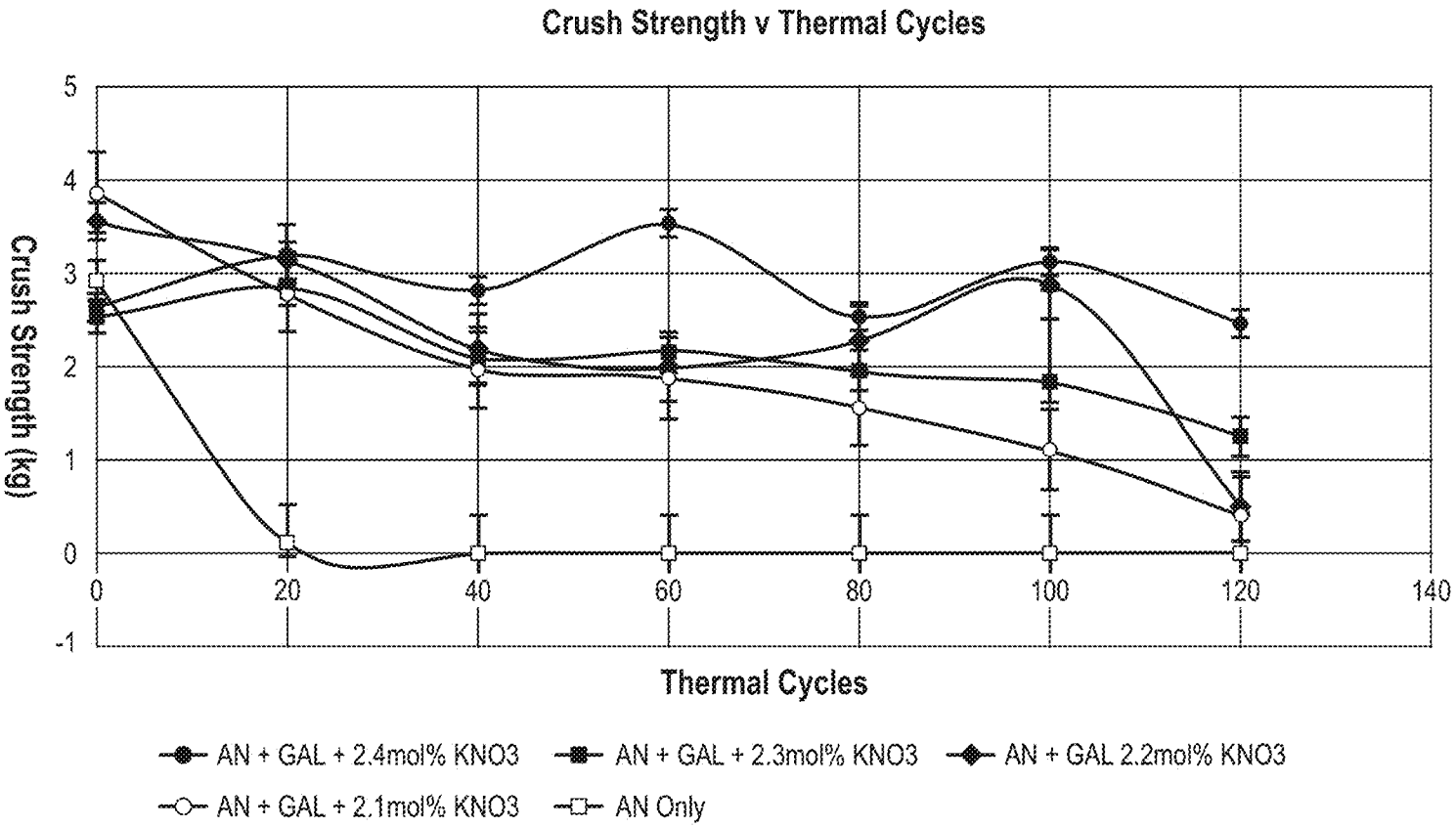
FIG. 25 depicts exemplary crush strength versus thermal cycling for exemplary prilloids with further various potassium concentrations.

These samples were thermally cycled a total of 120 times, and the results are shown in Table 6 and FIG. 25.

TABLE 6

| Sample | Average Crush Strength (kg) Initial (0 cycles) | Average Crush Strength (kg) 20 cycles | % Change from Initial Average Crush Strength (20 cycles) | Average Crush Strength (kg) 40 cycles | % Change from Initial Average Crush Strength (40 cycles) | Average Crush Strength (kg) 60 cycles | % Change from Initial Average Crush Strength (60 cycles) |
|---|---|---|---|---|---|---|---|
| AN + GAL + 2.4 mol % KNO3 | 2.655 | 3.169 | 19.4 | 2.824 | 6.4 | 3.521 | 32.6 |
| AN + GAL + 2.3 mol % KNO3 | 2.541 | 2.848 | 12.1 | 2.111 | −16.9 | 2.175 | −14.4 |
| AN + GAL + 2.2 mol % KNO3 | 3.543 | 3.146 | −11.2 | 2.182 | −38.4 | 1.970 | −44.4 |
| AN + GAL + 2.1 mol % KNO3 | 3.856 | 2.781 | −27.9 | 1.985 | −48.5 | 1.883 | −51.2 |

| Sample | Average Crush Strength (kg) Initial (0 cycles) | Average Crush Strength (kg) 80 cycles | % Change from Initial Average Crush Strength (80 cycles) | Average Crush Strength (kg) 100 cycles | % Change from Initial Average Crush Strength (100 cycles) | Average Crush Strength (kg) 120 cycles | % Change from Initial Average Crush Strength (120 cycles) |
|---|---|---|---|---|---|---|---|
| AN + GAL + 2.4 mol % KNO3 | 2.655 | 2.533 | −4.6 | 3.111 | 17.2 | 2.469 | −7.0 |
| AN + GAL + 2.3 mol % KNO3 | 2.541 | 1.959 | −22.9 | 1.822 | −28.3 | 1.261 | −50.4 |
| AN + GAL + 2.2 mol % KNO3 | 3.543 | 2.273 | −35.8 | 2.890 | −18.4 | 0.514 | −85.5 |
| AN + GAL + 2.1 mol % KNO3 | 3.856 | 1.568 | −59.3 | 1.112 | −71.2 | 0.411 | −89.3 |

The 2.1 mol %, 2.2 mol %, and 2.3 mol % batches began to show levels of powder/fines from 60 thermal cycles onwards. The 2.4 mol % batch did not show any significant level of fines even at 120 thermal cycles.

Example 16—Analysis of Alternative Interfacial Surface Modifier

Prilloid batches were produced using the method of Example 1. Instead of GAL as the interfacial surface modifier, aluminum sulfate was used. These batches were subjected to thermal cycling and crush strength analysis.

These batches included:

1) AN Only
2) AN+0.07% Al2SO4
3) AN+0.07% Al2SO4+3.5 mol % KNO3
4) AN+0.07% Al2SO4+2.5 mol % KNO3

Figure 26:
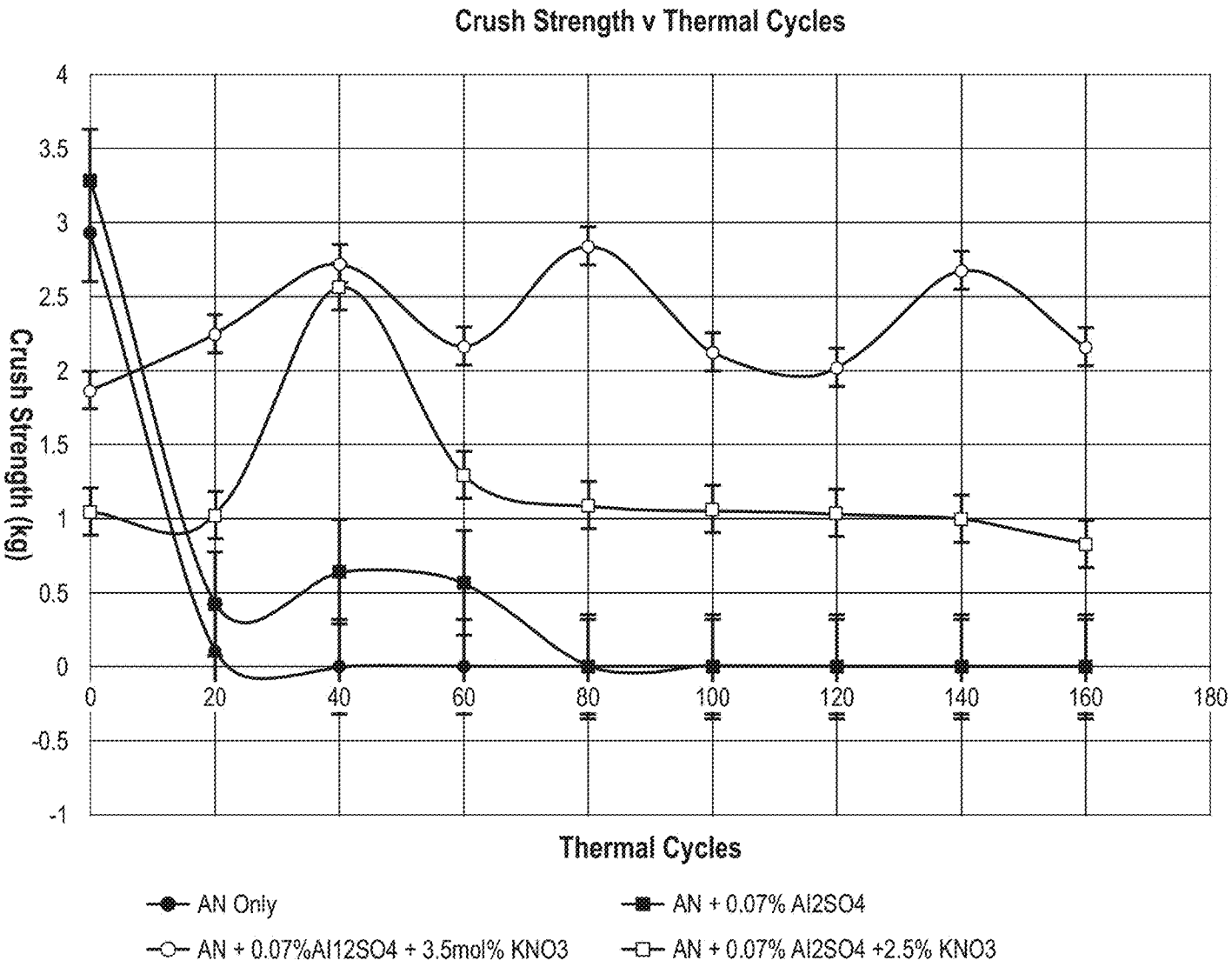
FIG. 26 depicts exemplary crush strength versus thermal cycling for exemplary prilloids with different concentrations of an exemplary interfacial surface modifier.

These samples were thermally cycled a total of 160 times, and the results are shown in Table 7 and FIG. 26.

TABLE 7

| Sample | Average Crush Strength (kg) Initial (0 cycles) | Average Crush Strength (kg) 20 cycles | % Change from Initial Average Crush Strength (20 cycles) | Average Crush Strength (kg) 40 cycles | % Change from Initial Average Crush Strength (40 cycles) | Average Crush Strength (kg) 60 cycles | % Change from Initial Average Crush Strength (60 cycles) |
|---|---|---|---|---|---|---|---|
| AN Only | 2.93 | 0.110 | −96.2 | Unable to Crush - Sample is powder | | Unable to Crush - Sample is powder | |
| AN + 0.07% Al2SO4 | 3.283 | 0.421 | −87.2 | 0.631 | −80.8 | 0.559 | −83 |
| AN + 0.07% Al2SO4 + 3.5 mol % KNO3 | 1.870 | 2.250 | 20.3 | 2.719 | 45.4 | 2.169 | 16.0 |
| AN + 0.07% Al2SO4 + 2.5 mol % KNO3 | 1.041 | 1.017 | −2.3 | 2.568 | 146.7 | 1.289 | 23.8 |

TABLE 7-continued

| | Average Crush Strength (kg) Initial (0 cycles) | Average Crush Strength (kg) 80 cycles | % Change from Initial Average Crush Strength (80 cycles) | Average Crush Strength (kg) 100 cycles | % Change from Initial Average Crush Strength (100 cycles) | Average Crush Strength (kg) 120 cycles | % Change from Initial Average Crush Strength (120 cycles) |
|---|---|---|---|---|---|---|---|
| AN Only | 2.93 | Unable to Crush - Sample is powder | | Unable to Crush - Sample is powder | | Unable to Crush - Sample is powder | |
| AN + 0.07% Al2SO4 | 3.283 | Unable to Crush - Sample is powder | | Unable to Crush - Sample is powder | | Unable to Crush - Sample is powder | |
| AN + 0.07% Al2SO4 + 3.5 mol % KNO3 | 1.870 | 2.846 | 52.2 | 2.122 | 13.5 | 2.017 | 7.9 |
| AN + 0.07% Al2SO4 + 2.5 mol % KNO3 | 1.041 | 1.080 | 3.7 | 1.061 | 1.9 | 1.025 | −1.5 |

| Sample | Average Crush Strength (kg) Initial (0 cycles) | Average Crush Strength (kg) 140 cycles | % Change from Initial Average Crush Strength (140 cycles) | Average Crush Strength (kg) 160 cycles | % Change from Initial Average Crush Strength (160 cycles) |
|---|---|---|---|---|---|
| AN Only | 2.93 | Unable to Crush - Sample is powder | | Unable to Crush - Sample is powder | |
| AN + 0.07% Al2SO4 | 3.283 | Unable to Crush - Sample is powder | | Unable to Crush - Sample is powder | |
| AN + 0.07% Al2SO4 + 3.5 mol % KNO3 | 1.870 | 2.679 | 43.3 | 2.164 | 15.7 |
| AN + 0.07% Al2SO4 + 2.5 mol % KNO3 | 1.041 | 1.002 | −3.7 | 0.830 | −20.3 |

The crush testing data demonstrates that the AN Only and AN+0.07% Al2SO4 prilloids were degraded significantly after 20 thermal cycles, and continued to degrade with thermal cycling, until they were unable to be crushed. The AN+0.07% Al2SO4+2.5 mol % KNO3, and the AN+0.07% Al2SO4+3.5 mol % KNO3 have both demonstrated a significantly improved ability to withstand the effects of thermal cycling.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A phase-stabilized ammonium nitrate (PSAN) prill comprising:

ammonium nitrate;

a porosity enhancing agent; and a potassium salt, wherein the PSAN prill comprises from 2.1 mole percent (mol %) to 5 mol % potassium ions of the potassium salt based on the ammonium ions of the ammonium nitrate, wherein the potassium salt comprises at least one of potassium hydroxide, potassium nitrate, potassium sulfate, potassium hydrogen sulfate, potassium carbonate, or potassium hydrogen carbonate;

wherein the PSAN prill is explosive grade and has a bulk density less than 0.9 kg/L, and wherein upon thermal cycling the PSAN prill 20 times, wherein one cycle comprises four hours at 15° C. followed by four hours at 45° C., an average crush strength of the thermal cycled PSAN prill is greater than an average crush strength of non-thermal cycled control PSAN prill.

2. The PSAN prill of claim 1, wherein the mol % of the potassium ions based on the ammonium ions is from 3 mol % to 5 mol %.

3. The PSAN prill of claim 1, wherein the PSAN prill has at least about 5.7% porosity.

4. The PSAN prill of claim 1, wherein the porosity enhancing agent comprises an interfacial surface modifier, a pore former, or both.

5. The PSAN prill of claim 4, wherein the interfacial surface modifier comprises at least one of an alkyl sultanate polymer, an alkaline metal salt of naphthalenesulfonic acid, an alkaline metal salt of alkyl sulfonic acid, an alkaline metal salt of polystyrene sulfonic acid, or aluminum sulfate hydrate.

6. The PSAN prill of claim 4, wherein the concentration of the interfacial surface modifier is from 400 ppm to 4,000 ppm.

7. The PSAN prill of claim 1, wherein the potassium salt comprises at least one of potassium hydroxide, potassium nitrate, or potassium sulfate.

8. The PSAN prill of claim 1, wherein the PSAN prill substantially lacks a 32° C. crystalline phase change.

9. The PSAN prill of claim 1, wherein the PSAN prill substantially lacks an 84° C. crystalline phase change.

10. The PSAN prill of claim 1, wherein upon thermal cycling the PSAN prill 50 times, wherein one cycle comprises four hours at 15° C. followed by four hours at 45° C., the thermal cycled PSAN prill has an average crush strength greater than 0.4 kg.

11. The PSAN prill of claim 1, wherein the shelf life of the PSAN prill is at least two months at an average daytime ambient temperature from about 30° C. to about 50° C. and an average night time temperature of about 10° C. to about 30° C.

12. The PSAN prill of claim 1, wherein crystal domains of the PSAN prill are more tightly packed and more uniform than the crystal domains of an explosive grade ammonium nitrate prill devoid of potassium and having similar density and porosity to the PSAN prill.

13. The PSAN prill of claim 1, wherein the PSAN prill comprises potassium uniformly distributed throughout the prill.

* * * * *